US010058195B2

(12) United States Patent
Bernard et al.

(10) Patent No.: US 10,058,195 B2
(45) Date of Patent: Aug. 28, 2018

(54) CAN DISPENSER

(71) Applicant: Menasha Corporation, Neenah, WI (US)

(72) Inventors: Ferdinand Wayne Bernard, Teaneck, NJ (US); John William Robinson, Bloomfield, NJ (US)

(73) Assignee: Menasha Corporation, Neenah, WI (US)

( * ) Notice: Subject to any disclaimer, the term of this patent is extended or adjusted under 35 U.S.C. 154(b) by 0 days.

(21) Appl. No.: 14/677,557

(22) Filed: Apr. 2, 2015

(65) Prior Publication Data

US 2016/0058204 A1 Mar. 3, 2016

Related U.S. Application Data

(60) Provisional application No. 62/041,731, filed on Aug. 26, 2014.

(51) Int. Cl.

| | |
|---|---|
| ***A47F 1/04*** | (2006.01) |
| ***A47F 1/08*** | (2006.01) |
| *A47B 73/00* | (2006.01) |

(52) U.S. Cl.

CPC ..... *A47F 1/087* (2013.01); *A47B 73/00* (2013.01); *A47F 1/04* (2013.01)

(58) Field of Classification Search

CPC .... A47F 1/087; A47F 1/04; A47F 1/00; A47F 7/281; A47F 3/02; A47F 7/28; A47F 1/08

USPC ..... 211/59.2, 59.3, 74; 312/45, 36, 72; 206/427; 221/175, 67, 104, 111, 109, 97

See application file for complete search history.

(56) References Cited

U.S. PATENT DOCUMENTS

| | | | | | |
|---|---|---|---|---|---|
| 265,400 | A * | 10/1882 | Fitch | B65D 83/0409 | 211/59.2 |
| 406,593 | A * | 7/1889 | O'Kelly | G07F 17/166 | 194/273 |
| 563,906 | A * | 7/1896 | Beretta | G07F 11/04 | 194/301 |
| 916,027 | A * | 3/1909 | Sausser | E21F 1/10 | 246/304 |
| 1,017,864 | A * | 2/1912 | Fyfe | B24B 27/0076 | 221/103 |

(Continued)

FOREIGN PATENT DOCUMENTS

| | | |
|---|---|---|
| WO | 2012012677 A1 | 1/2012 |
| WO | 2016033031 A1 | 3/2016 |

OTHER PUBLICATIONS

US Patent Office, International Search Report and Written Opinion of International Searching Authority for PCT/US2015/046675 dated Jan. 28, 2016 (9 pages).

*Primary Examiner* — Abigail E Troy
*Assistant Examiner* — Devin K Barnett
(74) *Attorney, Agent, or Firm* — Greensfelder, Hemker & Gale, P.C.

(57) ABSTRACT

The present invention provides a can dispenser for storing, moving, displaying and dispensing of cans while in the upright, as opposed to side, position. In one embodiment, the can dispenser includes a first inclined passageway, a drop section communicating with the first inclined passageway, and a second inclined passageway inclined in a direction opposite to the first inclined passageway and communicating with the drop section. The dispenser also includes a dispensing area communicating with the second inclined passageway.

7 Claims, 23 Drawing Sheets

(56) References Cited

U.S. PATENT DOCUMENTS 1,628,852 A * 5/1927 Lea ..... G07F 11/10 194/254
1,744,679 A * 1/1930 Sapp ..... G07F 11/48 221/111
1,753,957 A 4/1930 Washburn
2,304,484 A * 12/1942 Smith ..... G07F 11/32 221/109
2,382,191 A * 8/1945 Weichselbaum ..... A47F 1/087 193/27
2,389,283 A * 11/1945 Stewart ..... G07F 11/58 221/109
2,408,380 A * 10/1946 Dennis ..... A47F 1/087 193/27
2,442,025 A * 5/1948 Smith ..... G07F 11/32 193/17
2,562,015 A * 7/1951 Cattanach ..... G07F 11/32 194/244
2,628,875 A * 2/1953 Ossanna, Jr. ..... G07F 11/32 221/109
2,825,488 A * 3/1958 Nelson ..... G07F 9/10 219/214
2,888,145 A * 5/1959 Knott ..... A47F 1/087 211/59.2
3,043,474 A * 7/1962 Mullin ..... G07F 11/28 221/109
3,113,816 A * 12/1963 Hulsey ..... A47F 1/08 221/174
3,305,128 A * 2/1967 Dearsley ..... A24C 5/325 198/347.2
3,467,275 A * 9/1969 Barton ..... G07F 11/32 194/219
3,501,016 A 3/1970 Eaton
3,613,946 A * 10/1971 Klem ..... G07F 11/32 221/109
3,784,022 A * 1/1974 Beesley, Jr. ..... A47B 87/005 193/27
3,938,700 A * 2/1976 Camp ..... G07F 11/32 193/32
4,098,383 A * 7/1978 Carpman ..... B65D 71/00 193/2 R
4,105,126 A 8/1978 Deffner et al.
4,232,800 A * 11/1980 Martin ..... B65G 1/08 221/109
4,245,755 A * 1/1981 Craven ..... G07F 11/08 221/109
4,303,179 A * 12/1981 Spring ..... G07F 11/32 221/109
4,356,923 A * 11/1982 Young ..... A47F 7/28 211/184
4,474,297 A * 10/1984 Zucker ..... A47F 1/12 211/184
4,526,292 A * 7/1985 Waxman ..... A47F 1/10 221/131
4,653,964 A * 3/1987 Lenhart ..... B65G 47/1407 221/159
4,817,900 A * 4/1989 Whittington ..... A47B 57/585 211/162
4,823,984 A * 4/1989 Ficken ..... F25D 19/00 221/126
4,834,263 A * 5/1989 Becze ..... G07F 11/34 221/1
4,911,309 A * 3/1990 Stefan ..... A47F 1/087 211/189
4,997,106 A * 3/1991 Rockola ..... G07F 11/34 211/59.2
5,009,329 A * 4/1991 Farrentine ..... G07F 11/00 221/175
5,080,256 A * 1/1992 Rockola ..... G07F 11/34 193/2 A
5,176,288 A 1/1993 Craven
5,392,953 A * 2/1995 Maldanis ..... G07F 9/02 211/59.2
5,396,997 A * 3/1995 Johnson ..... A47F 1/087 211/59.2
5,413,229 A * 5/1995 Zuberbuhler ..... A47F 1/125 211/51
5,462,198 A * 10/1995 Schwimmer ..... G07F 11/34 221/130
5,700,075 A * 12/1997 Perone ..... A47F 1/08 221/131
5,743,430 A * 4/1998 Freixas ..... A47F 1/04 221/194
5,806,712 A * 9/1998 Siemsen ..... G07F 11/28 211/59.2
5,904,256 A * 5/1999 Jay ..... A47F 5/0025 211/175
5,960,988 A * 10/1999 Freixas ..... A47F 1/04 221/13
6,173,582 B1 * 1/2001 Hixson ..... A47F 1/087 62/3.64
6,352,174 B1 * 3/2002 Bauman ..... G07F 5/26 221/107
6,612,525 B2 * 9/2003 Bagdi ..... F16B 21/02 248/71
6,637,604 B1 * 10/2003 Jay ..... A47F 1/12 211/59.2
6,786,341 B2 * 9/2004 Stinnett ..... A47F 1/08 211/194
6,991,116 B2 * 1/2006 Johnson ..... A47F 1/087 211/59.2
7,631,771 B2 * 12/2009 Nagel ..... A47F 3/0486 211/59.3
7,690,518 B2 * 4/2010 Fincher ..... A47F 1/12 211/59.2
7,850,015 B1 * 12/2010 Mason ..... A47F 1/087 211/175
7,913,860 B2 * 3/2011 Merl ..... G07F 11/16 211/59.2
7,918,365 B2 * 4/2011 White ..... G07F 11/10 221/123
7,992,747 B2 * 8/2011 Bauer ..... A47F 1/087 206/817
8,113,382 B1 * 2/2012 Piersant ..... G07F 7/0609 221/102
8,308,023 B2 * 11/2012 Gelardi ..... A47F 1/087 221/31
8,317,273 B2 * 11/2012 Alexander ..... A47F 1/087 211/59.2
8,550,261 B2 * 10/2013 Loftin ..... A47F 1/087 211/59.2
8,657,126 B1 * 2/2014 Loftin ..... A47F 1/087 211/59.2
8,757,433 B2 * 6/2014 Machers ..... G07F 11/20 211/59.2
8,833,601 B2 * 9/2014 Zacherle ..... B65D 71/36 221/30
8,925,744 B1 * 1/2015 Jang ..... A47F 1/12 211/126.12
8,955,695 B2 * 2/2015 Bauer ..... 211/59.2
8,985,346 B2 * 3/2015 Bogdziewicz ..... A47F 1/087 211/59.2
9,174,785 B2 * 11/2015 Gelardi ..... A47F 1/087
9,615,674 B2 * 4/2017 Vitollo ..... A47F 1/087
2002/0179553 A1 * 12/2002 Squitieri ..... A47F 5/005 211/59.2
2003/0141313 A1 * 7/2003 Bates ..... B65D 71/36 221/32
2004/0011751 A1 * 1/2004 Johnson ..... A47F 1/087 211/59.2
2004/0020877 A1 * 2/2004 Boron ..... A47F 1/12 211/59.2
2004/0200789 A1 * 10/2004 Woodbury ..... A47F 1/087 211/59.2
2005/0127014 A1 * 6/2005 Richter ..... A47F 1/126 211/59.2
2005/0127015 A1 * 6/2005 Medcalf ..... A47F 7/28 211/59.2

(56) References Cited

U.S. PATENT DOCUMENTS

2006/0131321 A1* 6/2006 Nagelski ..... A47F 1/087 221/67
2007/0007221 A1* 1/2007 Mann ..... A47F 1/126 211/59.3
2007/0075028 A1* 4/2007 Nagel ..... A47F 3/0486 211/59.2
2007/0194037 A1* 8/2007 Close ..... B65D 5/5213 221/100
2008/0011696 A1* 1/2008 Richter ..... A47F 1/126 211/59.2
2008/0067188 A1* 3/2008 White ..... G07F 11/10 221/123
2008/0156751 A1* 7/2008 Richter ..... A47F 1/126 211/59.2
2008/0245813 A1* 10/2008 Johnson ..... A47F 1/087 221/194
2009/0212066 A1* 8/2009 Bauer ..... A47F 1/087 221/281
2009/0308885 A1* 12/2009 Sainato ..... G07F 11/30 221/194
2010/0032391 A1* 2/2010 Schneider ..... A47F 5/10 211/59.2
2010/0295424 A1* 11/2010 Alexander ..... A47F 1/087 312/109
2010/0307992 A1* 12/2010 Robertson ..... A47F 5/0043 211/59.2
2011/0121010 A1* 5/2011 Loftin ..... A47F 1/087 221/1
2011/0121011 A1* 5/2011 Gelardi ..... A47F 1/08 221/30
2011/0147323 A1* 6/2011 Sainato ..... A47F 1/12 211/59.2
2012/0018391 A1* 1/2012 Gelardi ..... A47F 1/087 211/59.2
2012/0067835 A1* 3/2012 Danehy ..... A47F 5/005 211/59.3
2012/0266437 A1* 10/2012 Camello ..... A47F 1/125 29/428
2013/0134119 A1* 5/2013 Loftin ..... A47F 5/0025 211/59.2
2013/0221020 A1* 8/2013 Zacherle ..... A47F 1/087 221/68
2013/0270203 A1* 10/2013 Burton ..... A47F 1/087 211/59.2
2014/0054249 A1* 2/2014 Loftin ..... A47F 1/087 211/59.2
2014/0054309 A1* 2/2014 Loftin ..... A47F 1/087 221/1
2014/0190912 A1* 7/2014 Bauer ..... A47F 1/087 211/59.2
2015/0001237 A1* 1/2015 Bauer ..... A47F 1/04 221/1
2015/0001244 A1* 1/2015 Bauer ..... A47F 1/04 221/197
2015/0014261 A1* 1/2015 Johnson ..... A47F 1/087 211/59.2
2015/0021283 A1* 1/2015 Bruegmann ..... A47F 1/12 211/59.2
2016/0262554 A1* 9/2016 Vitollo ..... A47F 1/087
2017/0172313 A1* 6/2017 Vitollo ..... A47F 1/087

* cited by examiner

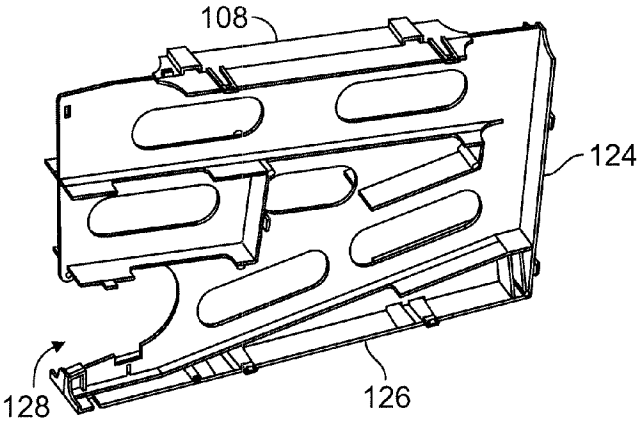
FIG. 6A
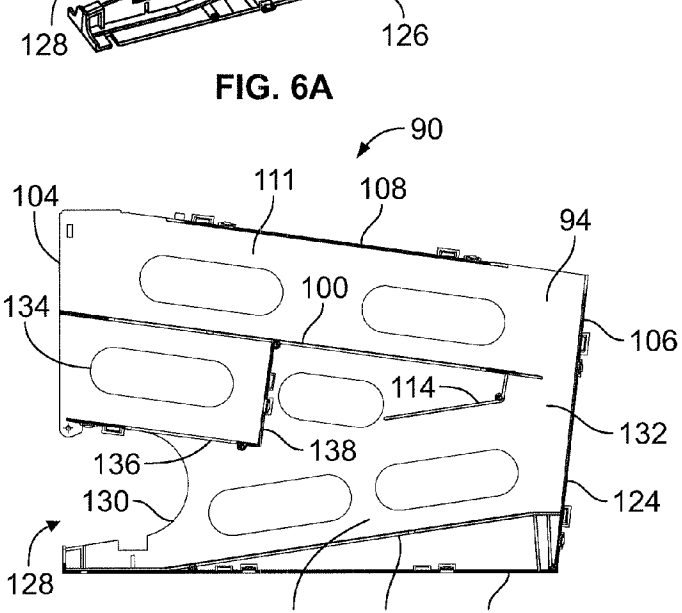
FIG. 6E
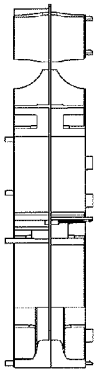
FIG. 6D
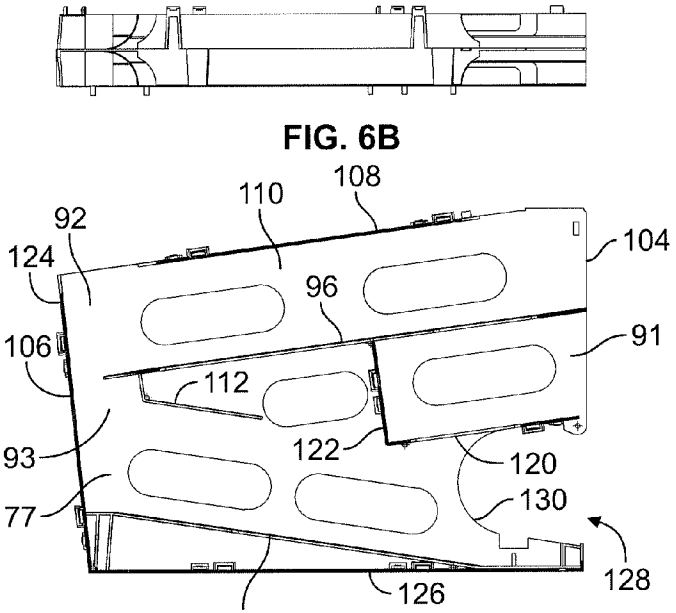
FIG. 6C
FIG. 6B

300

300

300
9D
9D

300

300
304

300
304'

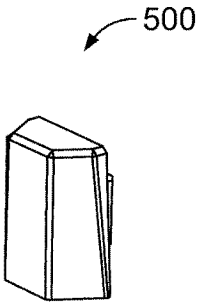
FIG. 10A
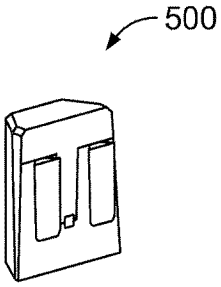
FIG. 10B
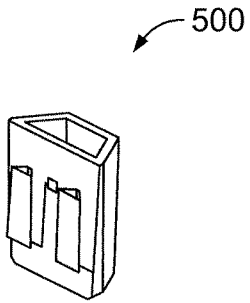
FIG. 10C
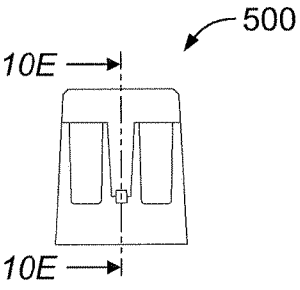
FIG. 10D
FIG. 10E
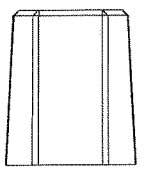
FIG. 10F
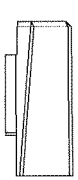
FIG. 10G
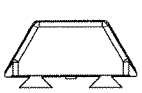
FIG. 10H
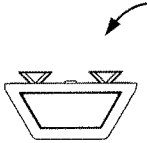
FIG. 10I

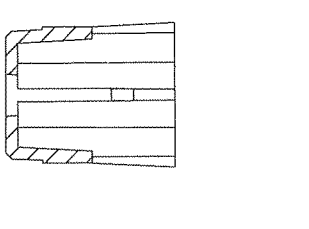
FIG. 11A
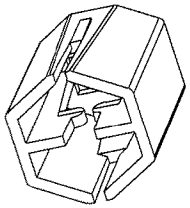
FIG. 11B
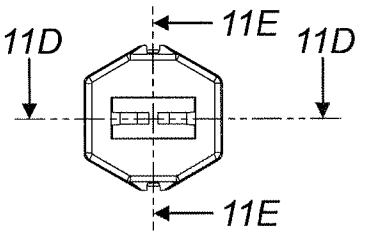
FIG. 11C
FIG. 11D
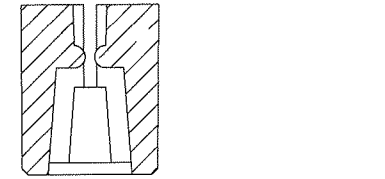
FIG. 11E
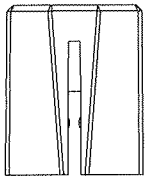
FIG. 11F
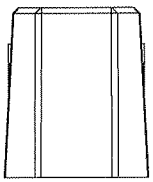
FIG. 11G
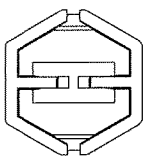
FIG. 11H

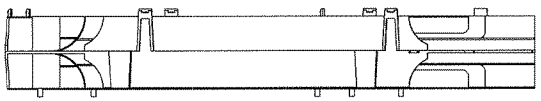
FIG. 15B
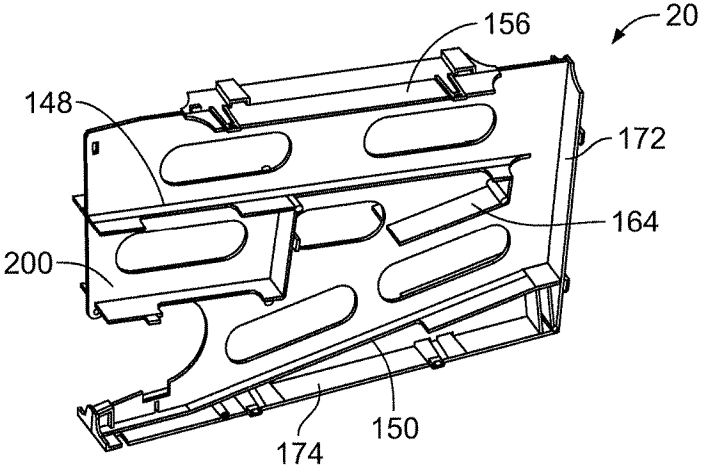
FIG. 15A
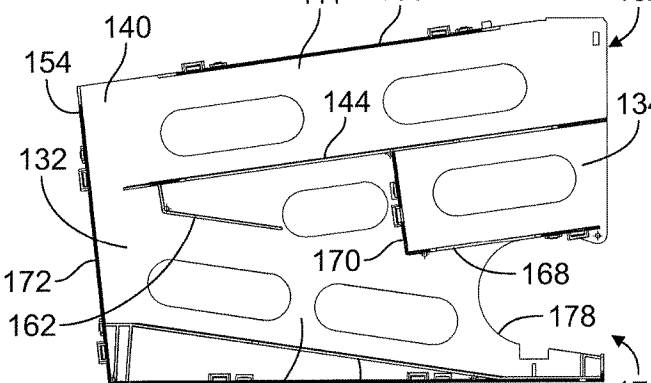
FIG. 15C
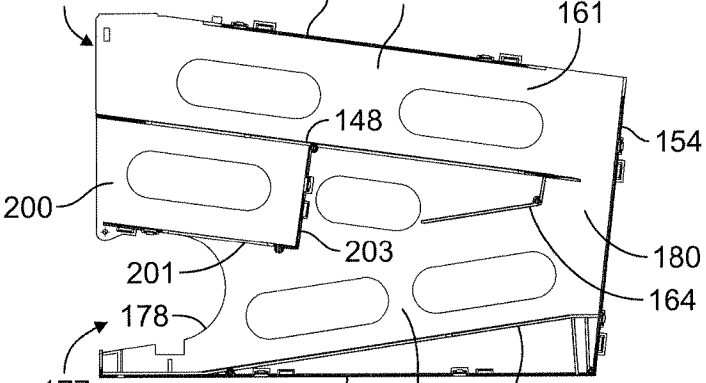
FIG. 15D
FIG. 15E

CAN DISPENSER

CROSS-REFERENCE TO RELATED APPLICATIONS

The present application claims the benefit of U.S. Provisional Application No. 62/041,731, filed Aug. 26, 2014, the contents of which are incorporated herein by reference.

FEDERALLY SPONSORED RESEARCH OR DEVELOPMENT

N/A

TECHNICAL FIELD

The present invention generally relates to a modular dispenser for cans for use in retail stores.

BACKGROUND OF THE INVENTION

It has become popular for cans, such as soda cans and soup cans, to be placed in retail displays rather than simply standing them up and stacking them on store shelves as in the past. These retail displays showcase the product in an attractive and organized manner, and call the consumer's attention to the products. They also allow for easy access to the desired product by the consumer. The can dispenser of the present invention provides a simple and improved modular dispenser for cans that permits multiple cans to be stored for quick access by consumers. The can dispenser of the present invention also allows for cans to be replaced in the front position for viewing by consumers by the force of gravity as cans are removed from the dispenser by the consumer.

SUMMARY OF THE INVENTION

The present invention provides a can dispenser. In one embodiment, the can dispenser includes a first inclined passageway, a drop section communicating with the first inclined passageway, and a second inclined passageway angularly inclined in a direction opposite to the first inclined passageway and communicating with the drop section. The dispenser also includes a dispensing area communicating with the second inclined passageway.

In another embodiment, the can dispenser of the present invention includes a left end panel. The left end panel includes a first inclined ramp and a second inclined ramp, both on an inner surface thereof. The second inclined ramp is inclined in a direction opposite to the first inclined ramp, The dispenser also includes a right end panel connectable to the left end panel. The right end panel includes a third inclined ramp cooperating with the first inclined ramp to form a first inclined passageway, and a fourth inclined ramp on an inner surface thereof cooperating with the second inclined ramp to form a second inclined passageway. The first inclined passageway is inclined in a direction opposite to the second inclined passageway.

In a further embodiment, the can dispenser of the present invention includes a left end panel. The left end panel includes a first inclined ramp and a second inclined ramp, both on an inner surface thereof. The second inclined ramp is inclined in a direction opposite to the first inclined ramp. The dispenser also includes a right end panel. The right end panel includes a third inclined ramp and a fourth inclined ramp on an inner surface thereof. The third inclined ramp is inclined in the same direction as the first inclined ramp, and the fourth inclined ramp inclined in the same direction as the second inclined ramp. The dispenser further includes a first center panel. The first center panel includes a fifth inclined ramp and a sixth inclined ramp, both on a first surface thereof, and seventh inclined ramp and an eighth inclined ramp, both on a second surface thereof. The fifth and sixth inclined ramps cooperate with the first and second inclined ramps of the left end panel to form first and second inclined passageways. The seventh and eighth inclined ramps cooperate with the third and fourth inclined ramps of the right end panel to form third and fourth inclined passageways. The first and third inclined passageways are inclined in a direction opposite to the second and fourth inclined passageways.

BRIEF DESCRIPTION OF THE DRAWINGS

To understand the present invention, it will now be described by way of example, with reference to the accompanying drawings in which:

FIGS. 6A-6E show a second center panel made in accordance with an embodiment of the present invention;

FIGS. 10A-10I show a first end stop made in accordance with an embodiment of the present invention;

FIGS. 11A-11H show a second end stop made in accordance with an embodiment of the present invention;

FIGS. 15A-15E show a third center panel made in accordance with an embodiment of the present invention;

DETAILED DESCRIPTION

Figure 1:
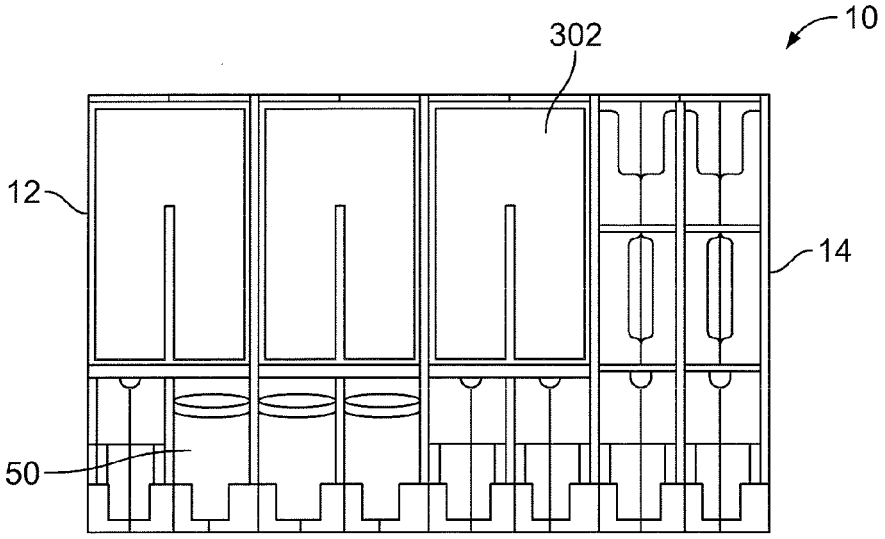
FIG. 1 is a perspective view of a can dispenser made in accordance with an embodiment of the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2B:
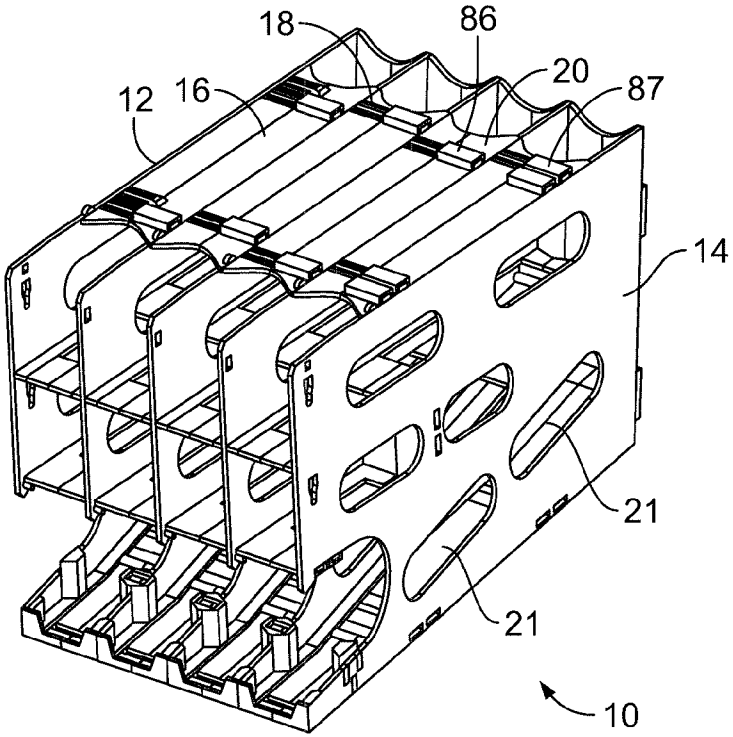
FIGS. 2A and 2B are perspective views of a can dispenser assembly made in accordance with an embodiment of the present invention.
Figure 2A:
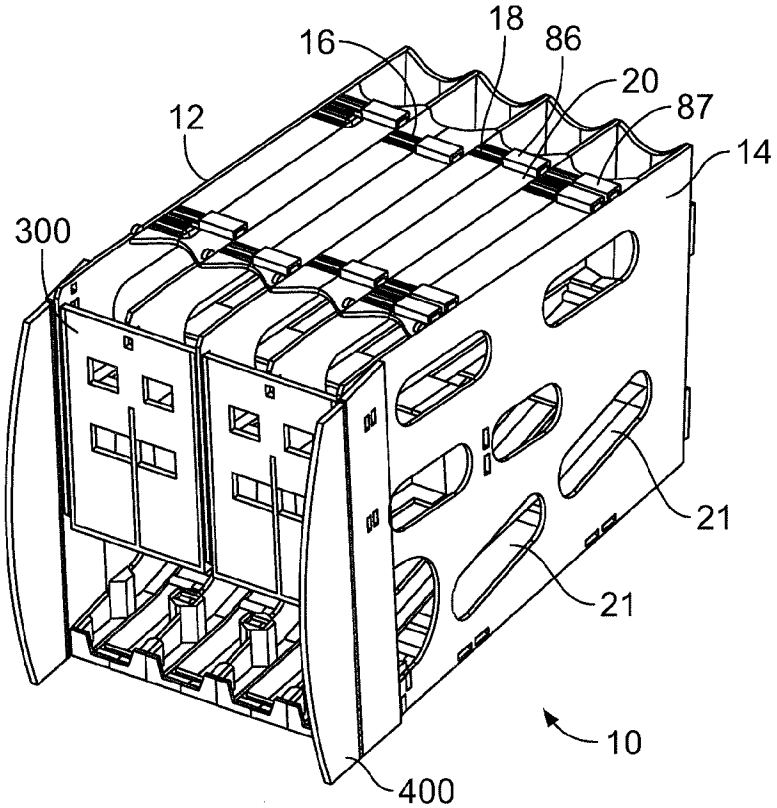
Figure 4A:
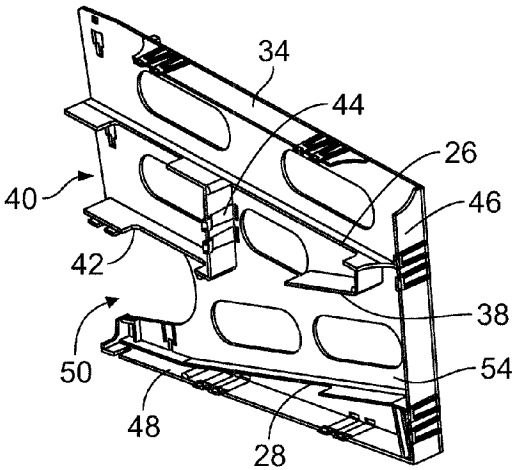
FIGS. 4A-4E show a left end panel made in accordance with an embodiment of the present invention.
Figure 4B:
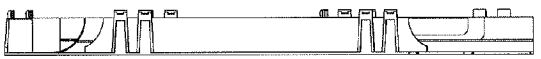
Figure 4C:
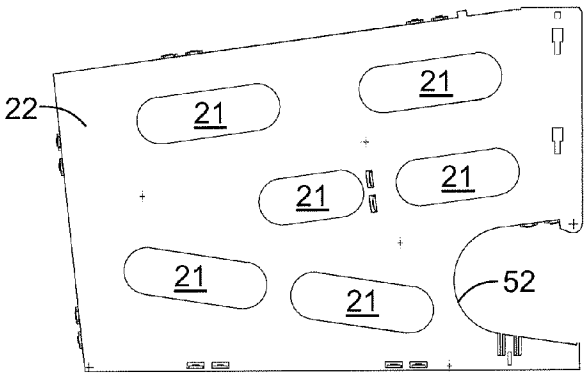
Figure 4D:
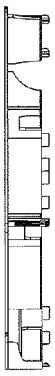
Figure 4E:
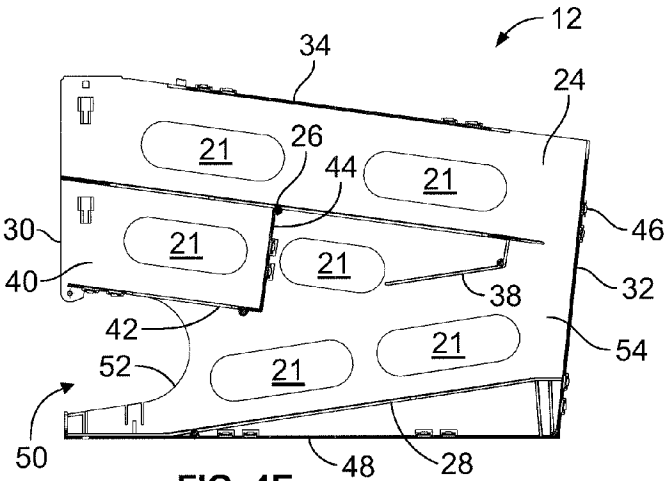
Figure 5A:
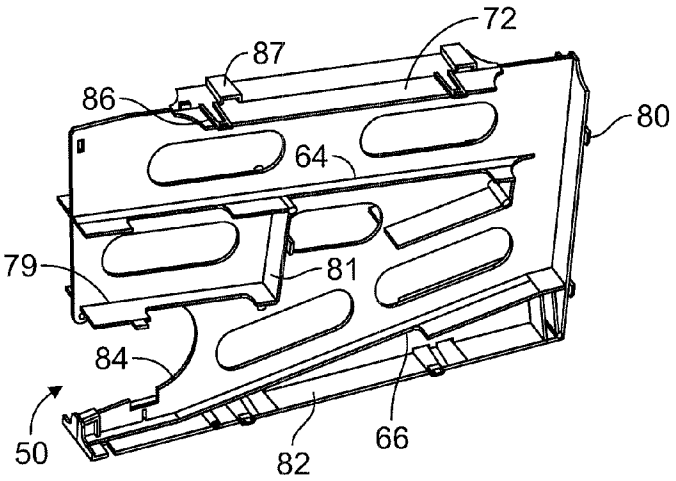
FIGS. 5A-5E show a first center panel made in accordance with an embodiment of the present invention.
Figure 5B:
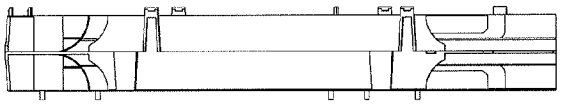
Figure 5E:
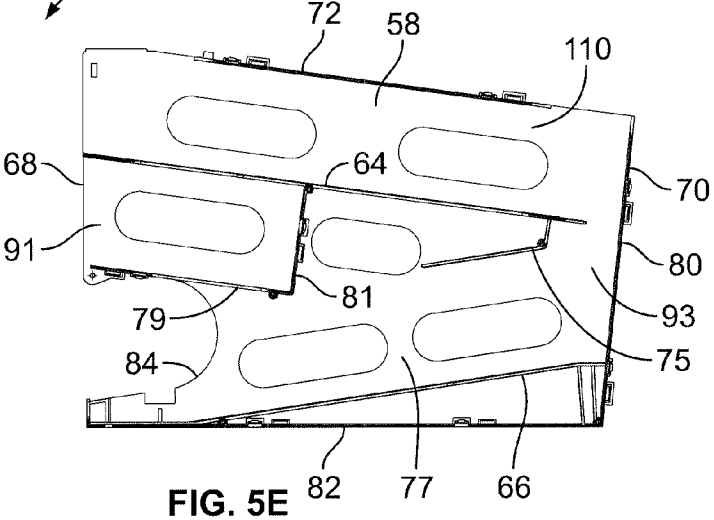
Figure 5D:
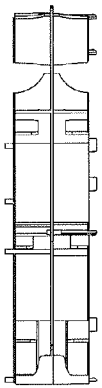
Figure 5C:
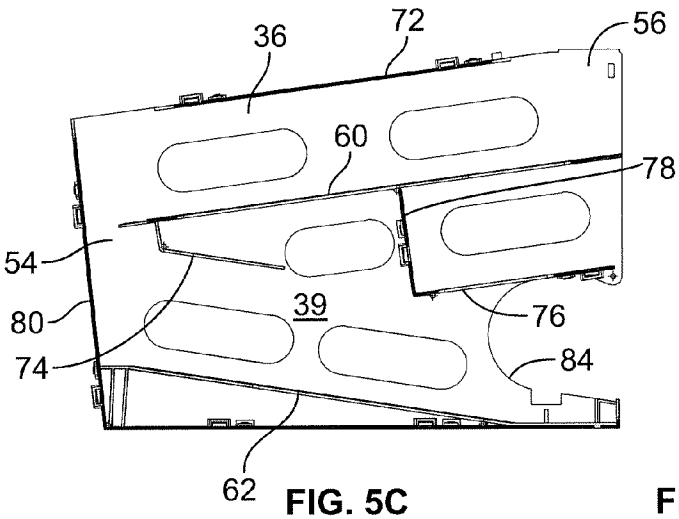
Figure 7A:
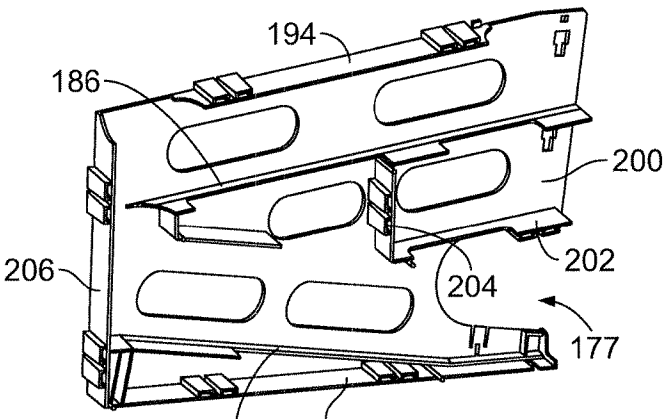
FIGS. 7A-7E show a right end panel made in accordance with an embodiment of the present invention.
Figure 7B:
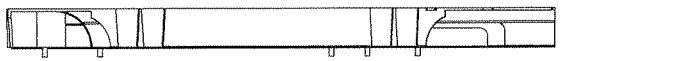
Figure 7E:
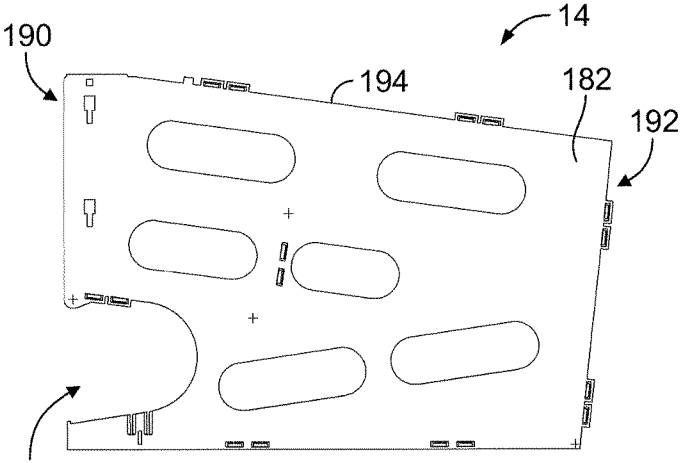
Figure 7D:
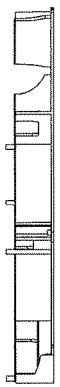
Figure 7C:
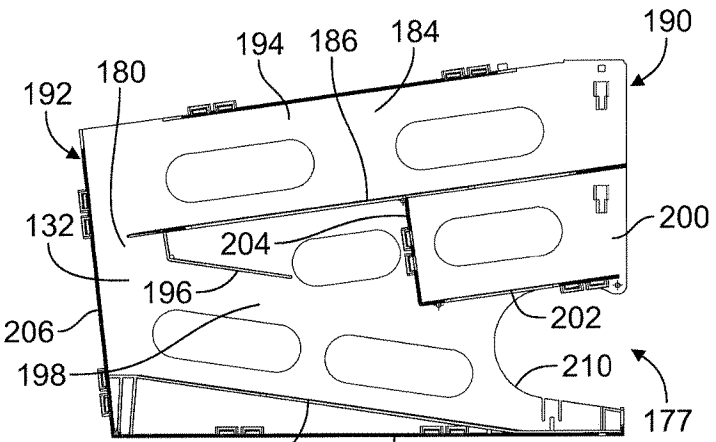
Figure 8:
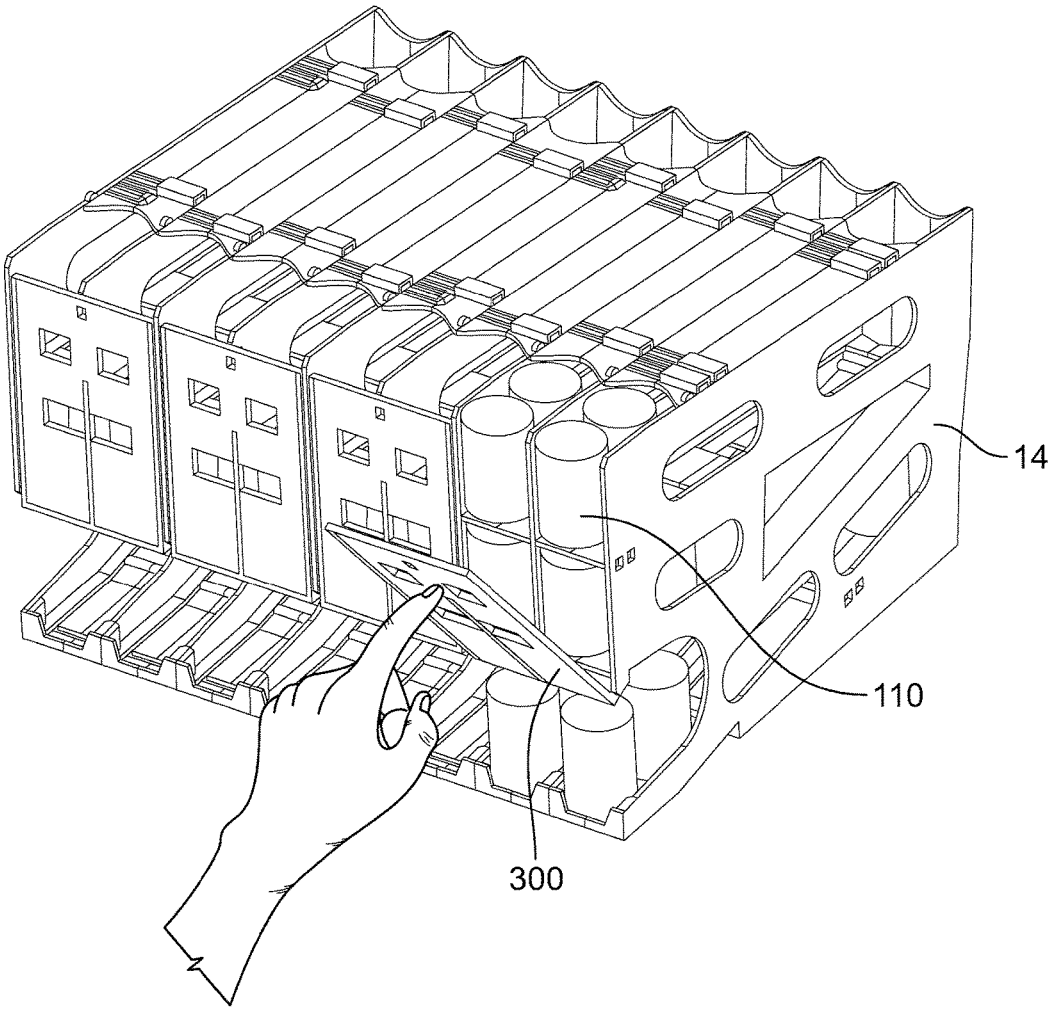
FIG. 8 is a perspective view of a can dispenser made in accordance with an embodiment of the present invention.
Figures 9A, 9B, 9C, 9D, 9E, 9F, 9G:
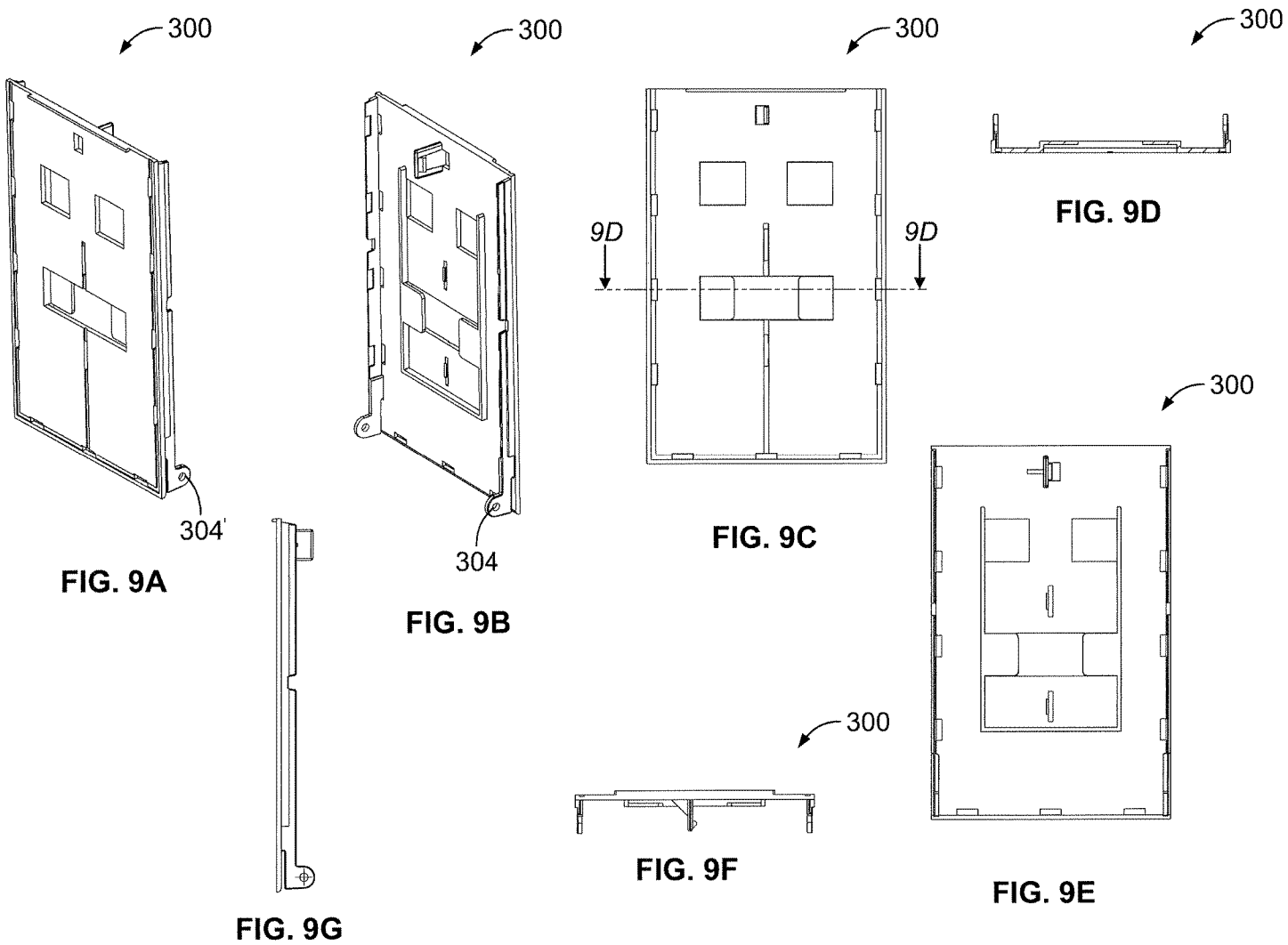
FIGS. 9A-9G show a front face panel made in accordance with an embodiment of the present invention.
Figure 12C:
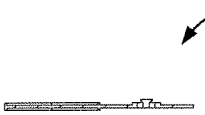
FIGS. 12A-12F show an aisle flag made in accordance with an embodiment of the present invention.
Figure 12D:
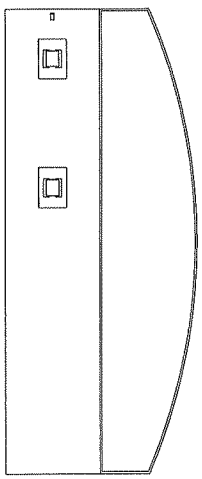
Figure 12B:
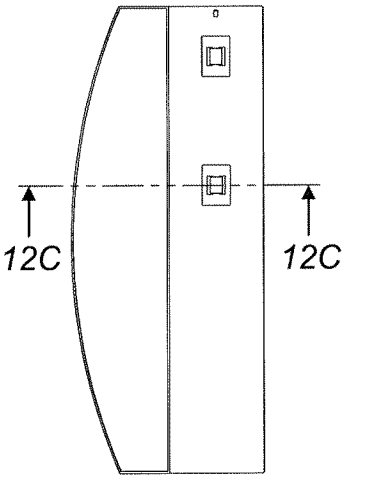
Figure 12E:
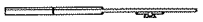
Figure 12A:
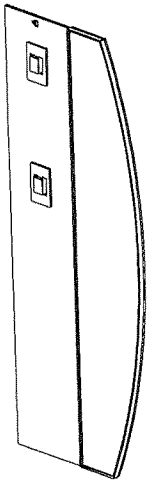
Figure 12F:
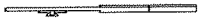
Figure 14:
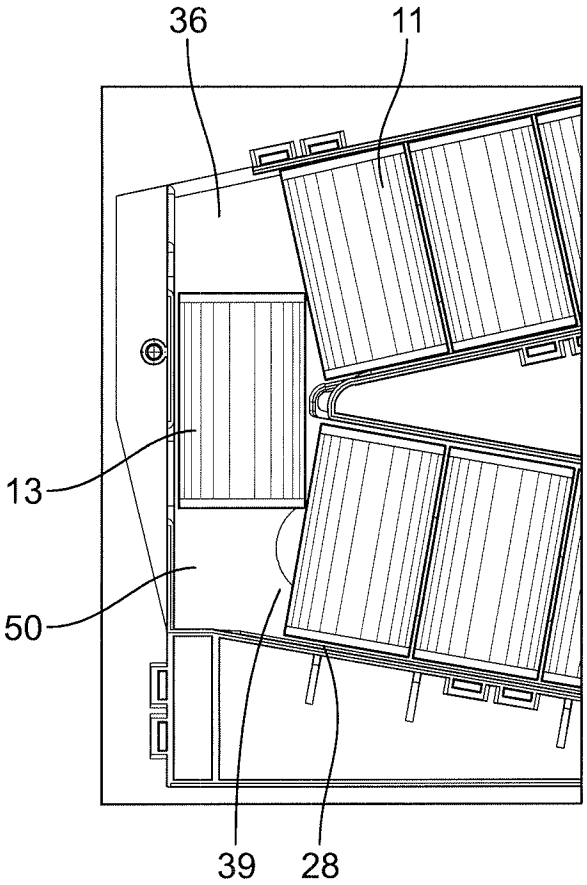
FIG. 14 is a perspective view of a portion of a can dispenser made in accordance with an embodiment of the present invention.
Figure 13:
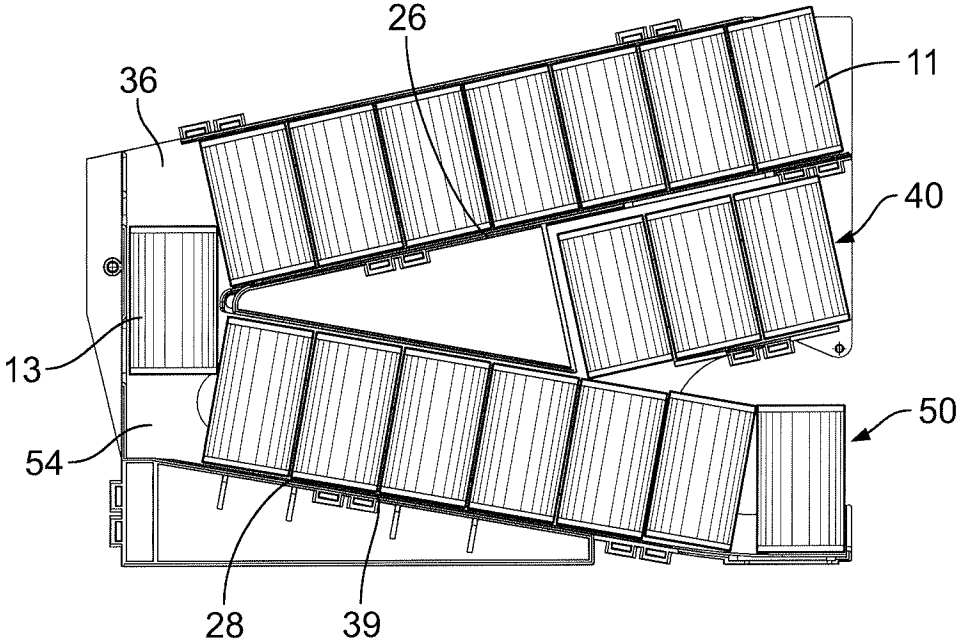
FIG. 13 is a perspective view of a portion of a can dispenser made in accordance with an embodiment of the present invention.
Figure 16B:
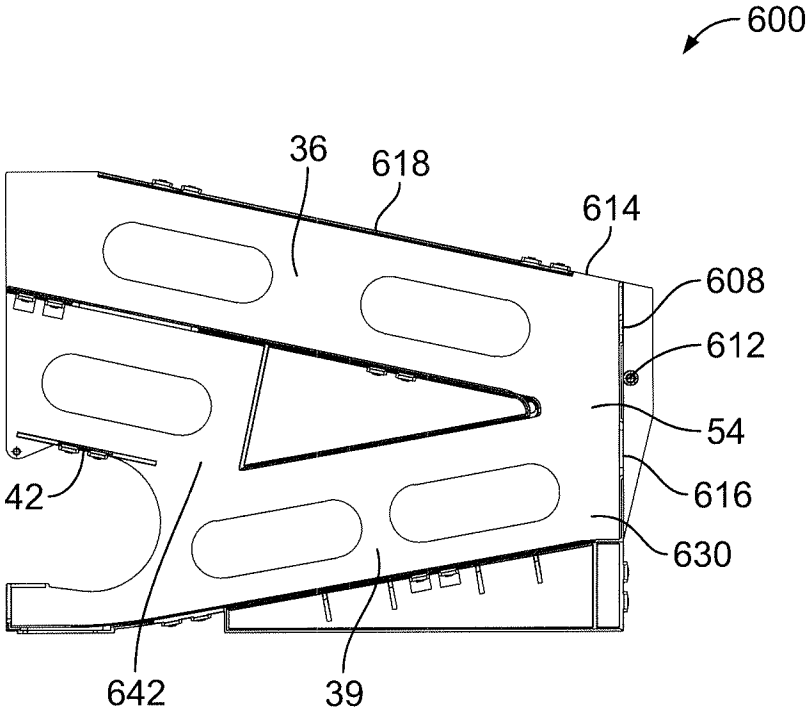
FIGS. 16A and 16B show a left end panel made in accordance with an embodiment of the present invention.
Figure 16A:
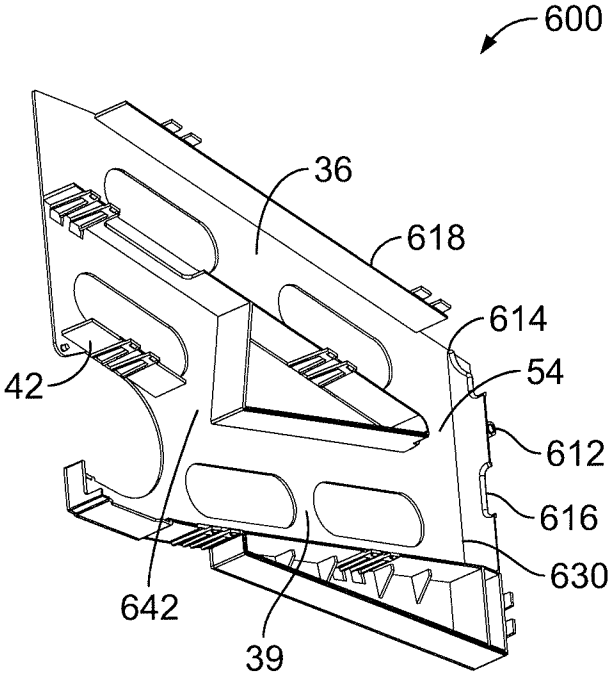
Figure 17B:
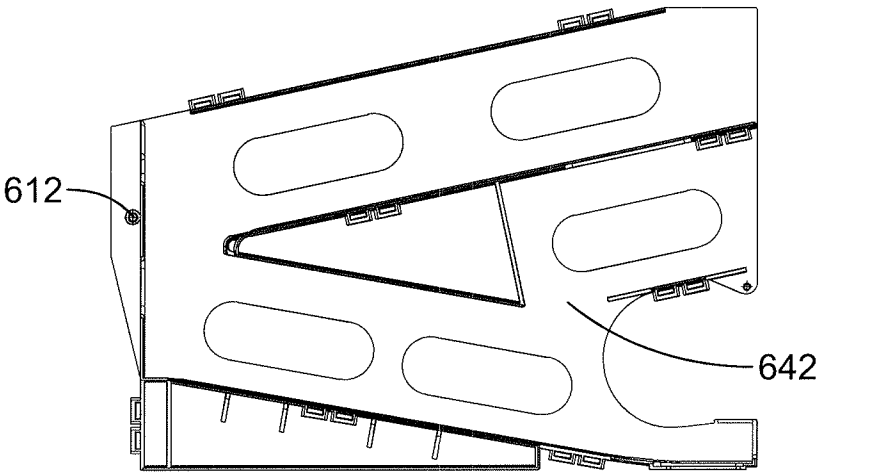
FIGS. 17A and 17B show a right end panel made in accordance with an embodiment of the present invention.
Figure 17A:
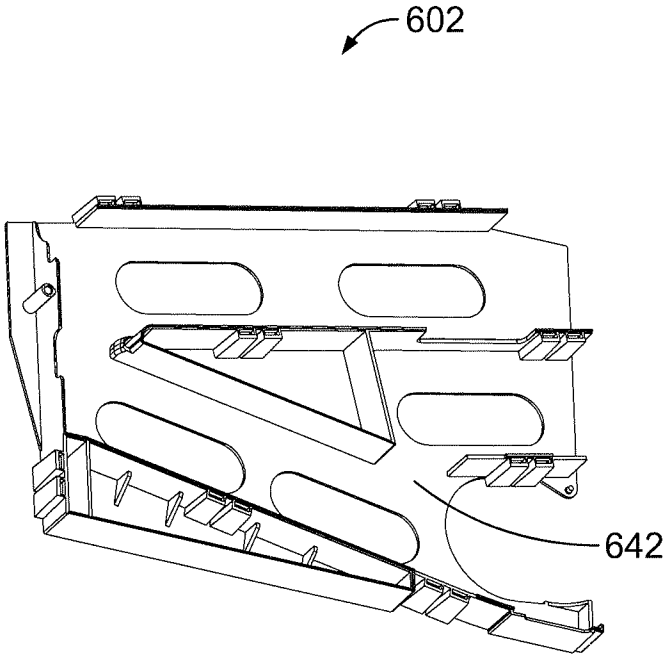
Figure 18B:
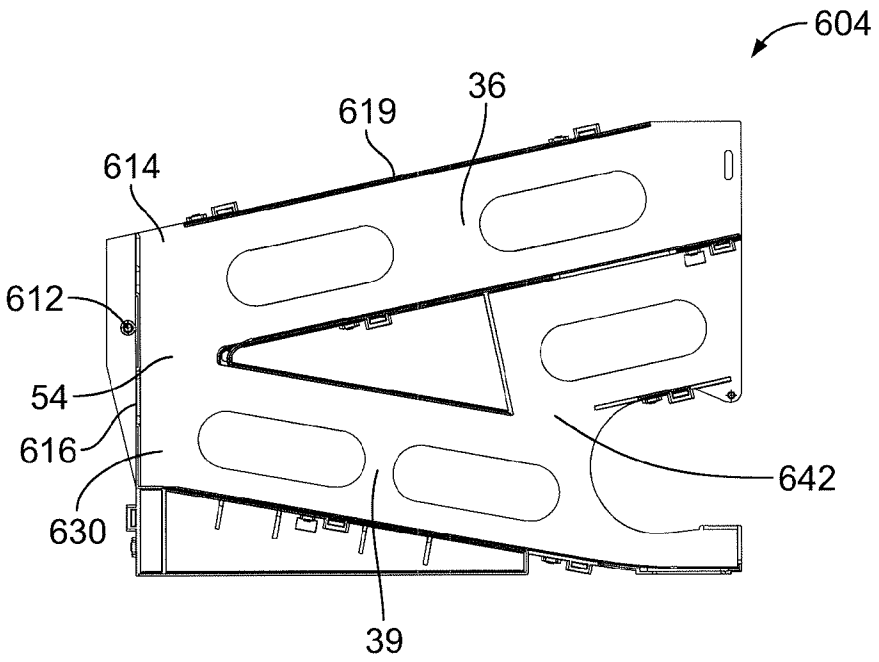
FIGS. 18A and 18B show a first center panel made in accordance with an embodiment of the present invention.
Figure 18A:
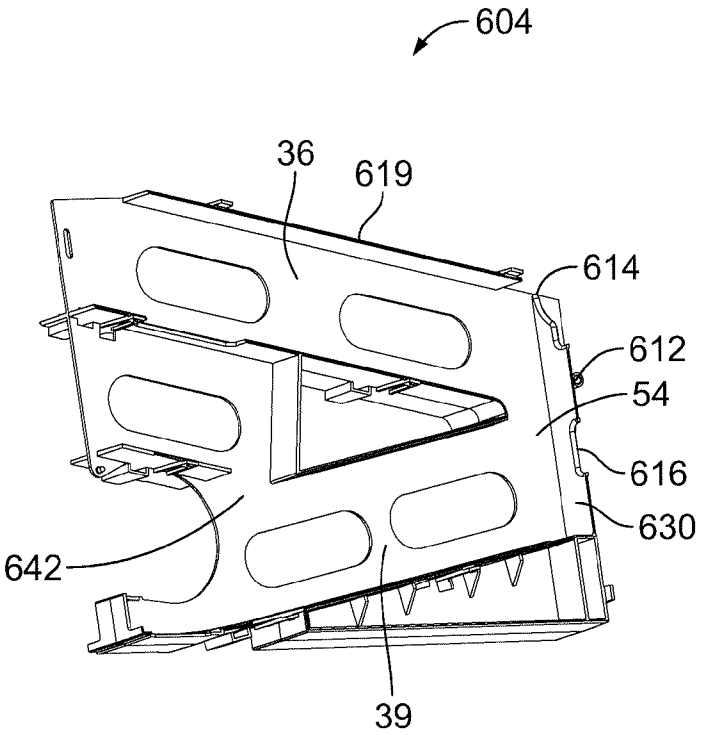
Figure 19B:
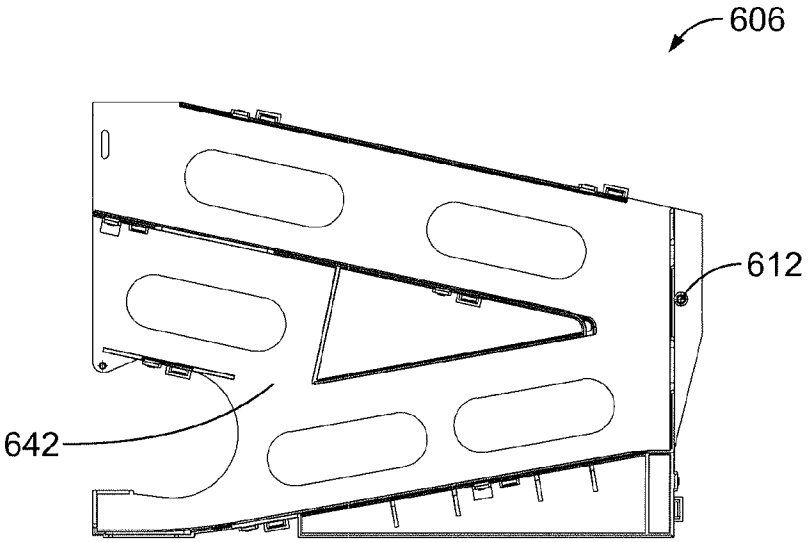
FIGS. 19A and 19B show a second center panel made in accordance with an embodiment of the present invention.
Figure 19A:
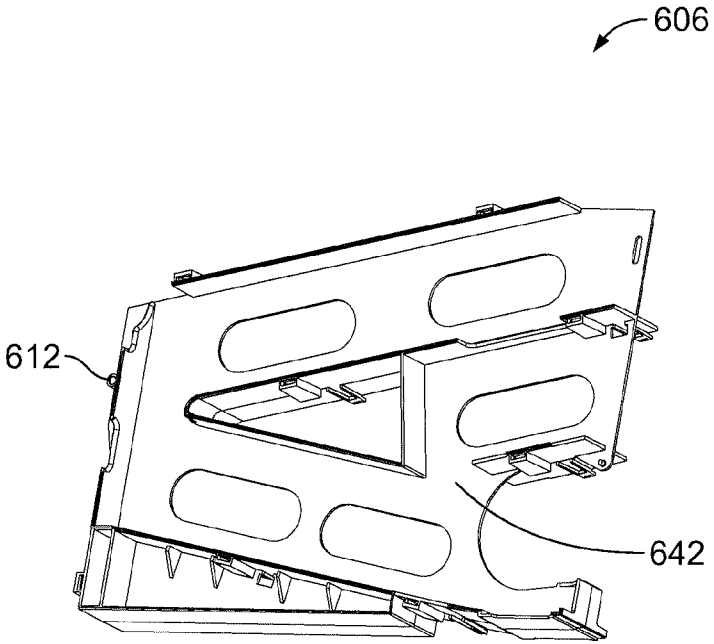
Figure 20C:
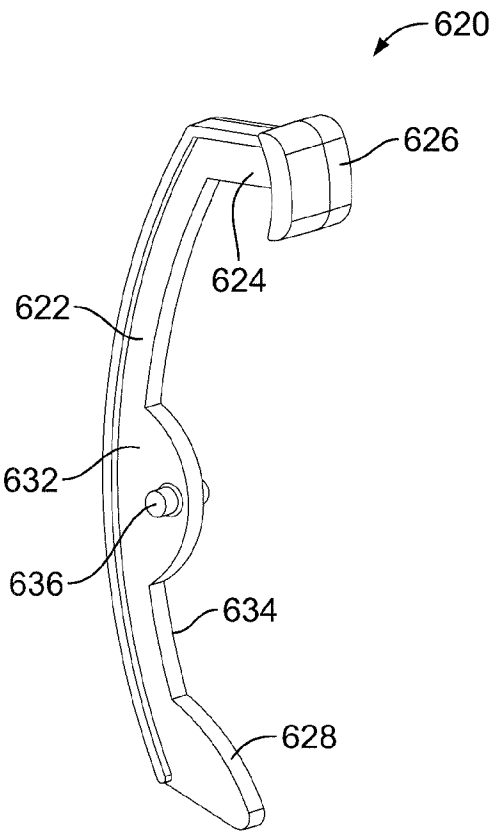
FIGS. 20A-20C show a rocker arm made in accordance with an embodiment of the present invention.
Figure 20B:
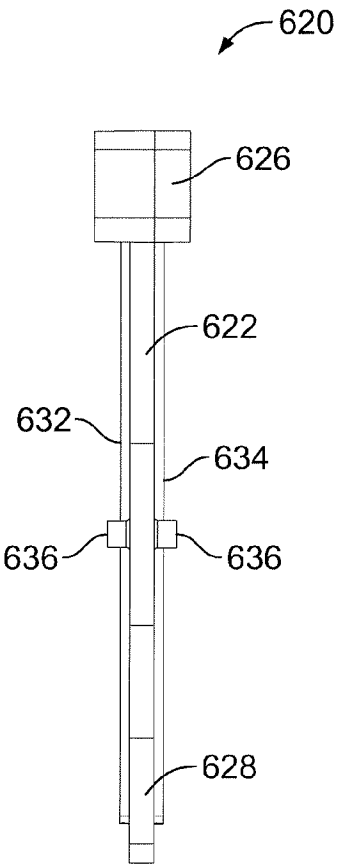
Figure 20A:
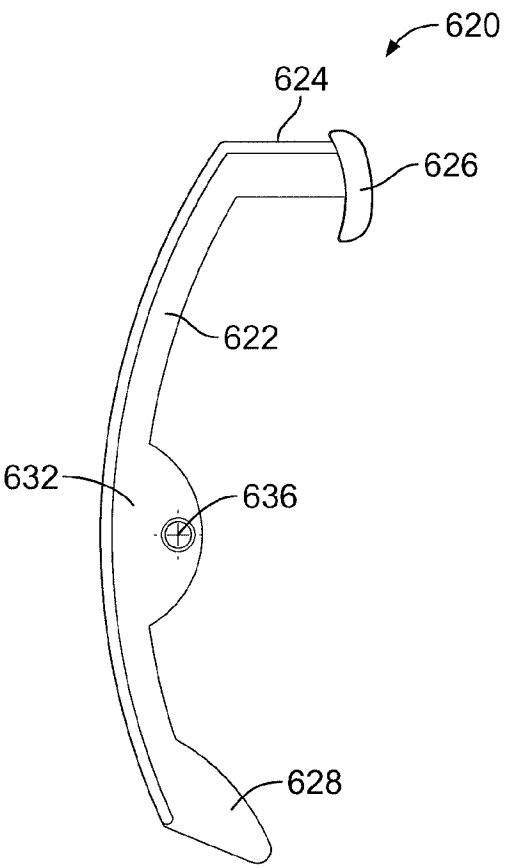
Figure 21B:
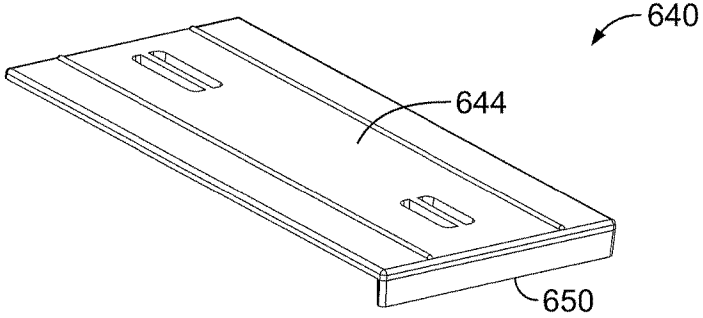
FIGS. 21A-21C show a sliding floor made in accordance with an embodiment of the present invention.
Figure 21C:
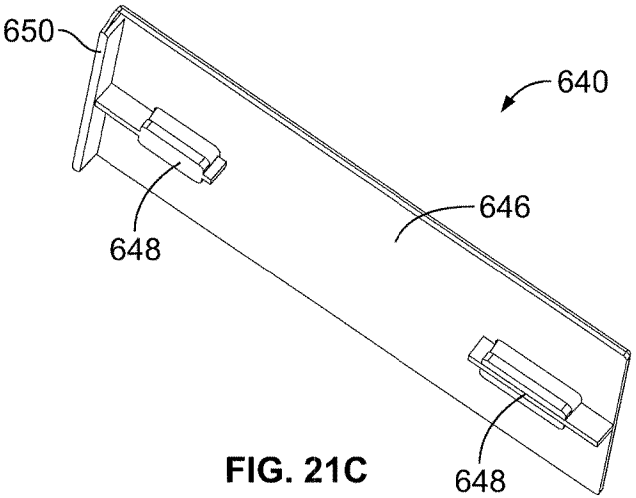
Figure 21A:
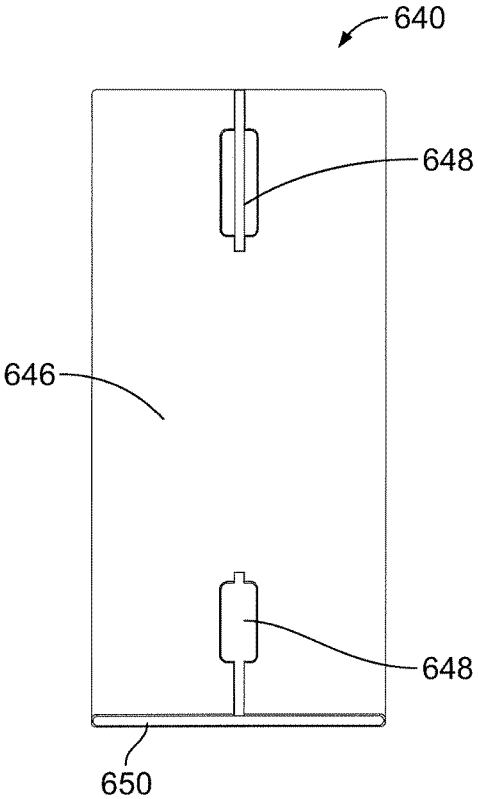
Figure 22:
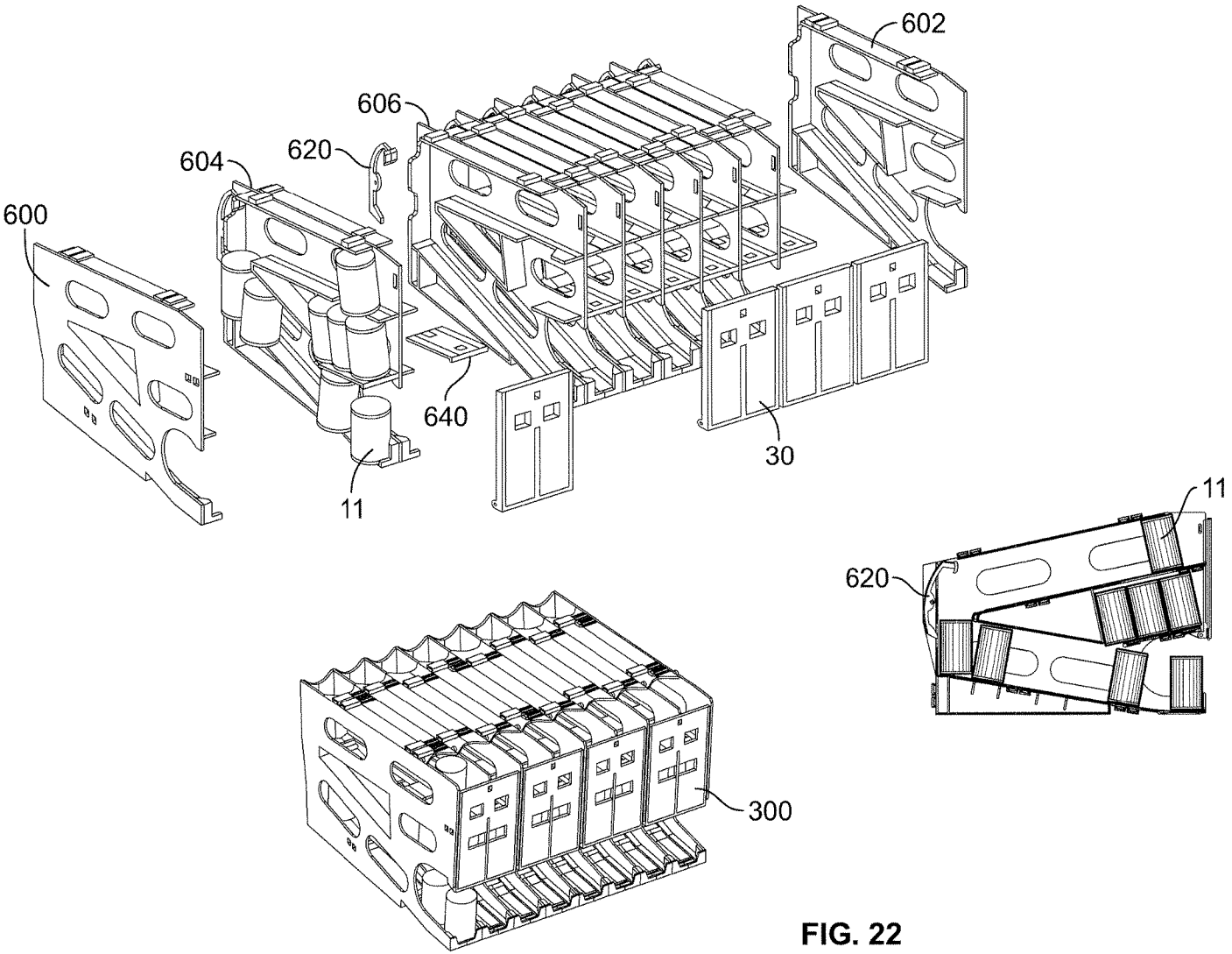
FIG. 22 is an assembly drawing showing assembly of a dispenser made in accord with an embodiment of the present invention.
Figure 24:
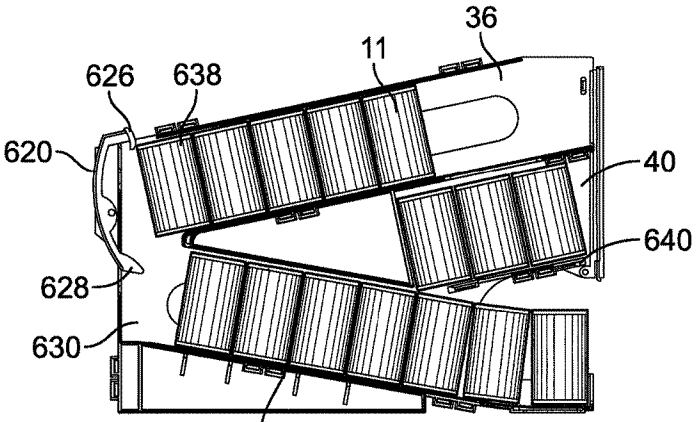
FIG. 24 is a cut-away drawing showing a rocker arm and sliding floor made in accord with an embodiment of the present invention.
Figure 23:
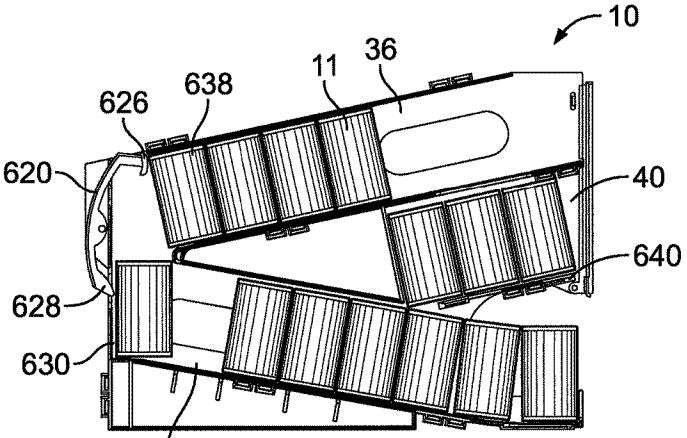
FIG. 23 is a cut-away drawing showing a rocker arm and sliding floor made in accord with an embodiment of the present invention.
Figure 25:
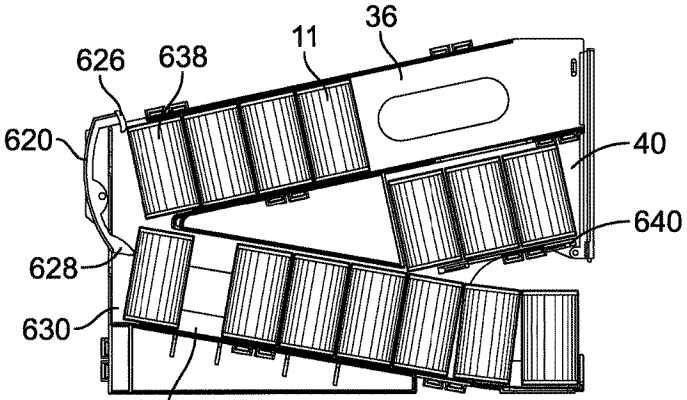
FIG. 25 is a cut-away drawing showing a rocker arm and sliding floor made in accord with an embodiment of the present invention.
Figure 27:
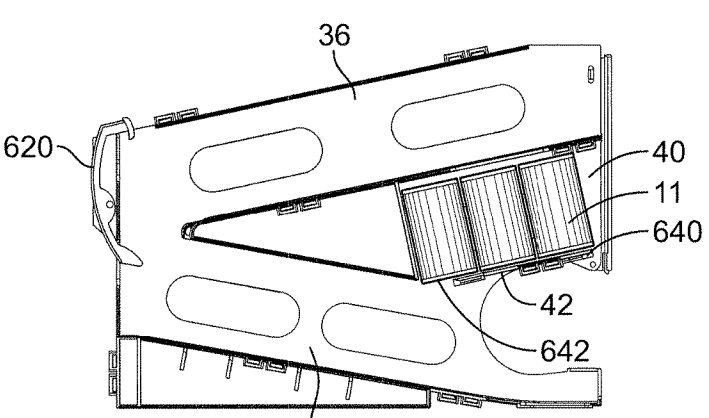
FIG. 27 is a cut-away drawing showing a rocker arm and sliding floor made in accord with an embodiment of the present invention.
Figure 26:
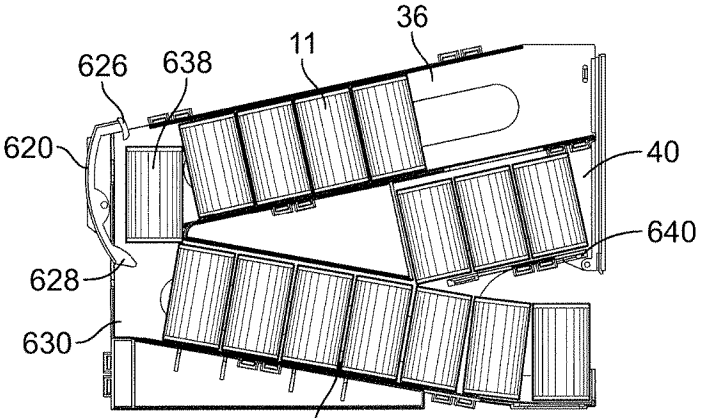
FIG. 26 is a cut-away drawing showing a rocker arm and sliding floor made in accord with an embodiment of the present invention.
Figure 28:
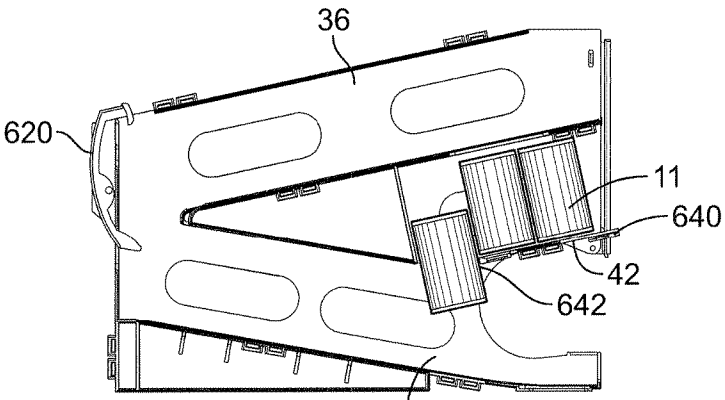
FIG. 28 is a cut-away drawing showing a rocker arm and sliding floor made in accord with an embodiment of the present invention.
Figure 30:
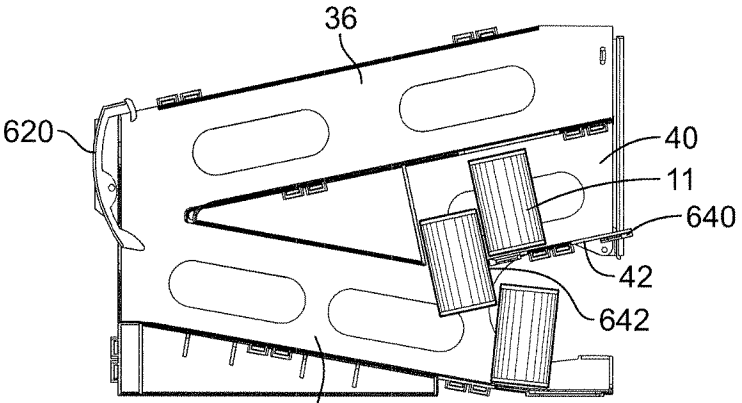
FIG. 30 is a cut-away drawing showing a rocker arm and sliding floor made in accord with an embodiment of the present invention.
Figure 29:
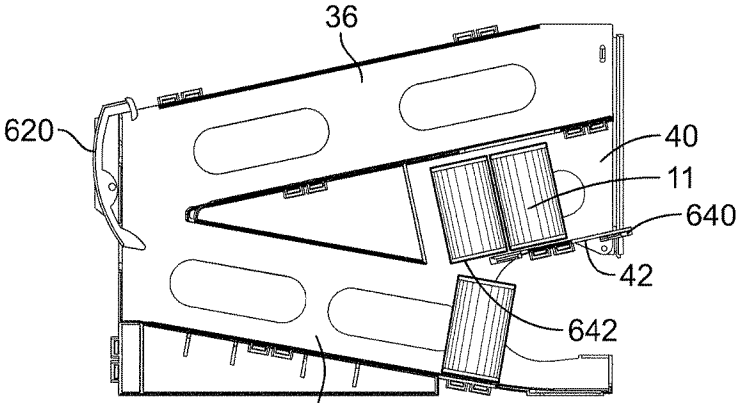
FIG. 29 is a cut-away drawing showing a rocker arm and sliding floor made in accord with an embodiment of the present invention.
Figure 31:
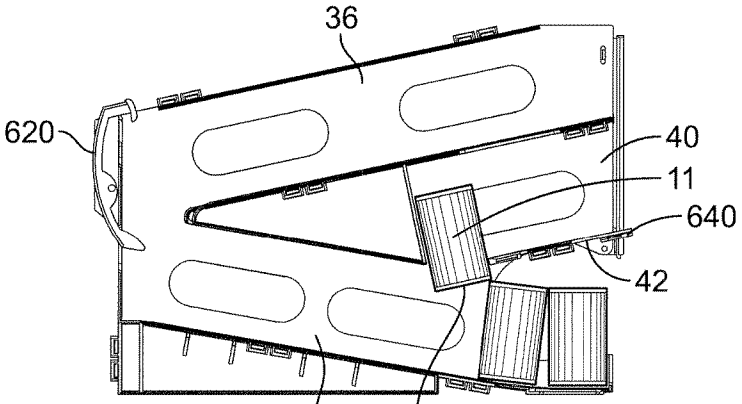
FIG. 31 is a cut-away drawings showing a rocker arm and sliding floor made in accord with an embodiment of the present invention.

Referring to the FIGS., a can dispenser assembly 10 is shown in FIGS. 1 and 2. In the embodiment shown, the assembly 10 includes a left end panel 12, a right end panel 14, a first center panel 16, a second center panel 18, and a third center panel 20. The panels 12,14,16,18,20 are preferably made of plastic, but can be made of any suitable material. The panels can include openings 21 to make the panels lighter and reduce the amount of plastic material needed for their construction.

Figure 3:
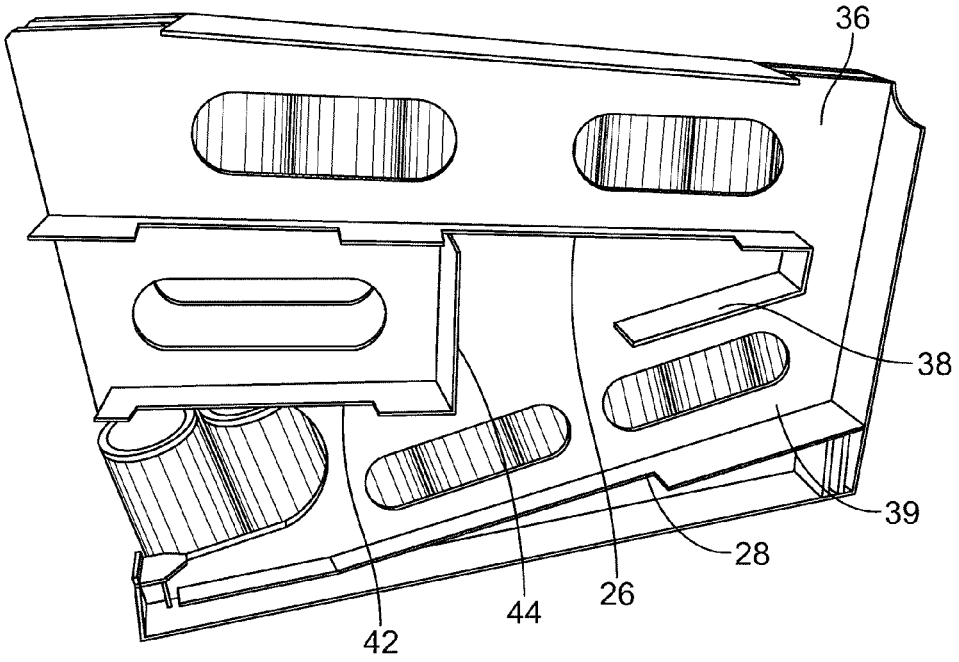
FIG. 3 is a side view of a first center panel and left end panel made in accordance with an embodiment of the present invention.

The left end panel 12 has an outer surface 22 and an inner surface 24. On the inner surface 24, the left end panel 12 has a first inclined ramp 26 and a second inclined ramp 28 (FIG. 3). The first and second inclined ramps 26,28 are inclined generally in a downward direction. The left end panel 12 also includes a front portion 30 and a rear portion 32. The first inclined ramp 26 is inclined toward the rear portion 32. The second inclined ramp 28 is inclined toward the front portion 30. Thus, the second inclined ramp 28 is inclined in a direction generally opposite to the first inclined ramp 26. The first inclined ramp 26 is inclined from the horizontal at an angle in a range of approximately 6-25 degrees, with a preferred angle of approximately 20 degrees, or any suitable angle such that cans can slide along the ramp 26 in an upright position (as opposed to on their sides) by the force of gravity. The second inclined ramp 28 is inclined from the horizontal at an angle in a range of approximately 6-25 degrees, with a preferred angle of approximately 20 degrees, or any suitable angle such that cans can slide along the ramp 28 by the force of gravity.

The first inclined ramp 26 extends inward from the inner surface 24 of the left end panel 12. Also extending from the inner surface 24 is a first top flange 34. The first top flange 34 is inclined at the same angle as the first inclined ramp 26 and forms a portion of a first passageway 36 with the first center panel 16 as will be described below.

The second inclined ramp 28 extends inward from the inner surface 24 of the left end panel 12. Also extending from the inner surface 24 is a first guide flange 38. The first guide flange 38 is located below the first inclined ramp 26 and above the second inclined ramp 28 and forms a part of a second passageway 39 with the first center panel 16 as will be described below. First guide flange 38 is inclined at the same angle to the horizontal as the second inclined ramp 28.

A first storage portion 40 is further located on the inner surface 24 near the front portion 30 of the left end panel 12. The first storage portion 40 includes a first bottom shelf 42 and first rear wall 44. The top of the storage portion 40 is formed by a part of the first inclined ramp 26. The first storage portion 40 will be fully formed with the complimentary first center panel 16 as will be described below.

Extending inward from the inner surface 24 vertically along a rear edge of rear portion 32 of the left end panel 12 is a first back flange 46. Extending inward from an inner surface 24 horizontally along a bottom edge of the left end panel 12 is a first bottom flange 48.

The left end panel 12 also includes a first dispensing area 50 at a bottom of the front portion 30. The dispensing area 50 includes a generally oval shaped first cutout 52 in the left end panel 12. It also includes a portion of the first bottom flange 48.

The left end panel 12 further includes a first drop section 54 near the rear portion 32. The drop section 54 extends between the first and second inclined ramps 26,28, and will be fully formed with the first center panel 16 as will be described below.

The first center panel 16 includes a first surface 56 and a second opposite surface 58. Extending from the first surface 56 are a fifth inclined ramp 60 and a sixth inclined ramp 62. Extending from the second surface 58 are a seventh inclined ramp 64 and an eighth inclined ramp 66. The fifth and seventh inclined ramps 60,64 inclined in the same direction and at the same angle as the first inclined ramp 26. The sixth and eighth inclined ramps 62,66 are inclined in the same direction and at the same angle as the second inclined ramp 28.

The first center panel 16 also includes a front portion 68 and a rear portion 70 corresponding to the front and rear portions 30,32 of the left end panel 12. The fifth and seventh inclined ramps 60,64 are inclined toward the rear portion 70. The sixth and eighth inclined ramps 62,66 are inclined toward the front portion 68. Thus, the fifth and seventh inclined ramps 60,64 are inclined in a direction opposite to the sixth and eighth inclined ramps 62,66.

Also extending from the first surface 56 and second surface 58 is a second top flange 72. The second top flange 72 is inclined at the same angle as the fifth inclined ramp 60 and forms a portion of a first passageway 36 with the first center panel 16, and a portion of a third passageway 110 with a second center panel 18 as will be described below.

The seventh inclined ramp 64 extends inward from the first surface 56 of the first center panel 16. Also extending from the first surface 56 is a second guide flange 74. The second guide flange 74 is located below the fifth inclined ramp 60 and above the sixth inclined ramp 62. Second guide flange 74 is inclined at the same angle to the horizontal as the sixth inclined ramp 62 and forms a portion of the second passageway 39 with the left end panel as will be described below.

Extending from the second surface 58 is a third guide flange 75. The third guide flange 75 is located below the seventh inclined ramp 64 and above the eighth inclined ramp 66. Third guide flange 75 is inclined at the same angle to the horizontal as the eighth inclined ramp 66 and forms a part of a fourth passageway 77 with the second center panel 18 as will be described below.

A first storage portion 40 is located on the first surface 56 near the front portion 68 of the first center panel 16. The first storage portion 40 includes a second bottom shelf 76 and rear wall 78. The top of the first storage portion 40 is formed by a part of the fifth inclined ramp 60. The first storage portion 40 will be fully formed with the left end panel 12 as will be described below.

A second storage portion 91 is located on the second surface 58 near the front portion 68 of the first center panel 16. The second storage portion 91 includes a third bottom shelf 79 and a third rear wall 81. The top of the second storage portion 91 is formed by a part of the seventh inclined ramp 64. The second storage portion 91 will be fully formed with the second center panel 18 as will be described below.

Extending inward from the first surface 56 and second surface 58 vertically along a rear edge of rear portion 70 of the first center panel 16 is a second back flange 80. Extending inward from first surface 56 and second surface 58 horizontally along a bottom edge of the first center panel 16 is a second bottom flange 82.

The first center panel 16 also includes a first dispensing area 50 along first surface 56 at a bottom of the front portion 68. The first dispensing area 50 includes a generally oval shaped second cutout 84 in the first center panel 16, similar to the first cutout 52 in the left end panel 12. It also includes a portion of the second bottom flange 82. The first dispensing area 50 will be fully formed with the left end panel 12 as will be described below. The first center panel 16 also includes second dispensing area 51 along second surface 58 at the bottom of the front portion 68. The second dispensing area includes generally oval shaped second cutout 52, and will be fully formed with the second center panel 18.

The first center panel 16 further includes a first drop section 54 near the rear portion 70 and first inner surface 56. The first drop section 54 extends between the fifth and seventh inclined ramps 60 and 64, and will be fully formed with the first center panel 16 as will be described below. The first center panel 16 also includes a second drop section 93 near the rear portion 70 second inner surface 58. The second drop section 93 extend between the sixth and eighth inclined ramps 64,66, and will be fully formed with the second center panel 16 as will be described below.

The left end panel 12 and first center panel 16 are connected using tabs 86 and receptacles 87 such that their respect front portions 30,32,68,70 align, and such that first and fifth inclined ramps 26,60 and second and sixth inclined ramps 28,62 align and are adjacent one another to form first and second passageways 36,39. Similarly, the first and second top flanges 34,72 will align, as will the first and second bottom flanges 48,82, as will first and second back flanges 46,80, and first and second guide flanges 38,74. First and second bottom shelves 42,76, and first and second rear walls 4,78 align to form the first storage portion 40. First drop section 54 is also formed by the joining of the left end panel 12 and first center panel 16. First and second cutouts 52,84 and first and second bottom flanges 48,82 align to form the first dispensing area 50.

The can dispenser 10 operates as follows. Cans 11 are loaded standing on their ends along the first and second passageways 36,39. The cans 11 are supported by first and fifth inclined ramps 26,60 in the first passageway 36, and by the second and sixth inclined ramps 28 and 62 in the second passageway 39. The first and second top flanges 34,72 provide a ceiling for the first passageway 36. The first and second guide flanges 38,74 serve to guide the cans in the second passageway 39. As a can 11 is removed from the first dispensing area 50, the force of gravity moves the can 11 behind it into the first dispensing area 50. In turn, the remaining cans 11 slide along the inclined ramps in the first and second passageways and move up to the space previously occupied by the can 11 in front of it. A can 13 at the end of the first passageway 36 drops into the first drop section 54. The can 13 in the first drop section 54 is supported by the can 11 at the end of the second passageway 39 and prevents a can 11 in the first passageway 36 from entering the first drop section 54.

When the next can is removed, the cans 11 again move up in the same manner. Cans 11 can be stored in the first storage portion 40 and replaced into the first passageway 36 when needed.

It will be understood that the can dispenser 10 of the present invention is intended to be modular such that additional center panels can be added as needed to create a dispenser 10 of the desired size. Additional center panels can be added to create a wider display, as large a display as needed (FIG. 15). In the embodiment shown, a second center panel 18 is included. The second center panel 18 has a first inner surface 92 and a second opposite inner surface 94. Extending from the first surface 92 are a ninth inclined ramp 96 and a tenth inclined ramp 98. Extending from the second surface 94 are an eleventh inclined ramp 100 and a twelfth inclined ramp 102. The ninth and eleventh inclined ramps 96,100 are inclined in the same direction and at the same angle as the first inclined ramp 26. The tenth and twelfth inclined ramps 98,102 are inclined in the same direction and at the same angle as the second inclined ramp 28.

The second center panel 18 also includes a front portion 104 and a rear portion 106 corresponding to the front and rear portions 30,32 of the left end panel 12. The ninth and eleventh inclined ramps 96,100 are inclined toward the rear portion 106. The tenth and twelfth inclined ramps 98,102 are inclined toward the front portion 104. Thus, the ninth and eleventh inclined ramps 96,100 are inclined in a direction opposite to the tenth and twelfth inclined ramps 98,102.

Also extending from the first surface 92 and second surface 94 is a third top flange 108. The third top flange 108 is inclined at the same angle as the ninth inclined ramp 96 and forms a portion of third passageway 110 with the first center panel 16, and a portion of a fifth passageway 111 with a third center panel 20 in a similar way as described above.

The ninth inclined ramp 96 extends inward from the first surface 92 of the second center panel 90. Also extending from the first surface 92 is a fourth guide flange 112. The fourth guide flange 112 is located below the ninth inclined ramp 96 and above the tenth inclined ramp 96. Fourth guide flange 112 is inclined at the same angle to the horizontal as the tenth inclined ramp 98, and forms a part of fourth passageway 77.

Extending from the second surface 94 is a fifth guide flange 114. The fifth guide flange 114 is located below the eleventh inclined ramp 100 and above the twelfth inclined ramp 102. Fifth guide flange 114 is inclined at the same angle to the horizontal as the twelfth inclined ramp 102 and forms a part of a sixth passageway 116 with a third center panel 20.

A second storage portion 91 is located on the first surface 92 near the front portion 104 of the second center panel 18. The second storage portion 91 includes a fourth bottom shelf 120 and fourth rear wall 122. The top of the second storage portion 91 is formed by a part of the ninth inclined ramp 96. The second storage portion 91 will be fully formed with the first center panel 16 similar to the first storage portion 40 described above.

A third storage portion 134 is located on the second surface 94 near the front portion 104 of the second center panel 18. The third storage portion 134 includes a fifth bottom shelf 136 and fifth rear wall 138. The top of the third storage portion 134 is formed by a part of the eleventh inclined ramp 100. The third storage portion 134 will be fully formed with the third center panel 20 similar to the first storage portion 40 described above.

Extending inward from the first surface 92 and second surface 94 vertically along the rear edge of rear portion 106 of the second center panel 18 is a third back flange 124. Extending inward from first surface 92 and second surface 94 horizontally along a bottom edge of the second center panel 18 is a third bottom flange 126.

The second center panel 18 also includes a second dispensing area 128 at a bottom of the front portion 104. The second dispensing area includes a generally oval shaped third cutout 130 in the second center panel 18, similar to the first cutout 52 in the left end panel 12. It also includes a portion of the third bottom flange 126. The second dispensing area 128 will be fully formed with the first center panel 16 as described above with respect to the left end panel 12 and first center panel 16.

The second center panel 18 further includes a second drop section 93 near the rear portion 106 and first inner surface 92. The second drop section 93 extends between the ninth and tenth inclined ramps 96,98, and will be fully formed with the first center panel. The second center panel 18 also includes a third drop section 132 near the rear portion 106 of second inner surface 94. The third drop section 132 extends between the eleventh and twelfth inclined ramps 100,102, and will be fully formed with a third center panel 18.

Third center panel 20 has a first inner surface 140 and a second opposite inner surface 142. Extending from the first surface 140 are a thirteenth inclined ramp 144 and a fourteenth inclined ramp 146. Extending from the second surface 142 are a fifteenth inclined ramp 148 and a sixteenth inclined ramp 150. The thirteenth and fifteenth inclined ramps 144,148 are inclined in the same direction and at the same angle as the first inclined ramp 26. The fourteenth and sixteenth inclined ramps 146,150 are inclined in the same direction and at the same angle as the second inclined ramp 28.

The third center panel 20 also includes a front portion 152 and a rear portion 154 corresponding to the front and rear portions 30,32 of the left end panel 12. The thirteenth and fifteenth inclined ramps 144,148 are inclined toward the rear portion 154. The fourteenth and sixteenth inclined ramps 146,150 are inclined toward the front portion 152. Thus, the thirteenth and fifteenth inclined ramps 144,148 are inclined in a direction opposite to the fourteenth and sixteenth inclined ramps 146,150.

Also extending from the first surface 140 and second surface 142 is a fourth top flange 156. The fourth top flange 156 is inclined at the same angle as the thirteenth and fifteenth inclined ramps 144,148 and forms a portion of fifth passageway 111 with the second center panel 18, and a portion of a seventh passageway 161 with right end panel 14.

The thirteenth inclined ramp 144 extends inward from the first surface 140 of the third center panel 20. Also extending from the first surface 44 is a sixth guide flange 162. The sixth guide flange 162 is located below the thirteenth ninth inclined ramp 144 and above the fourteenth inclined ramp 146. Sixth guide flange 162 is inclined at the same angle to the horizontal as the fourteenth inclined ramp 146, and forms a part of a sixth passageway 160.

Extending from the second surface 142 is a seventh guide flange 164. The seventh guide flange 164 is located below the fifteenth inclined ramp 148 and above the sixteenth inclined ramp 150. Seventh guide flange 164 is inclined at the same angle to the horizontal as the sixteenth inclined ramp 150 and forms a part of an eighth passageway 166 with the right end panel 14.

A third storage portion 134 is located on the first surface 140 near the front portion 152 of the third center panel 20. The third storage portion 134 includes a sixth bottom shelf 168 and sixth rear wall 170. The top of the third storage portion 134 is formed by a part of the thirteenth inclined ramp 144. The third storage portion 134 will be fully formed with the second center panel 18 similar to the first storage portion 40 described above.

Extending inward from the first surface 140 and second surface 142 vertically along the rear edge of rear portion 154 of the third center panel 20 is a fourth back flange 172. Extending inward from first surface 140 and second surface 142 horizontally along a bottom edge of the third center panel 20 is a fourth bottom flange 174.

The third center panel 20 also includes a third dispensing area 176 at a bottom of the front portion 152. The third dispensing area includes a generally oval shaped fourth cutout 178 in the third center panel 20, similar to the first cutout 52 in the left end panel 12. It also includes a portion of the fourth bottom flange 174. The third dispensing area 176 will be fully formed with the second center panel 18 as described above with respect to the left end panel 12 and first center panel 16.

The third center panel 18 further includes a third drop section 132 near the rear portion 154 and first inner surface 140. The third drop section 132 extends between the thirteenth and fourteenth inclined ramps 144,146, and will be fully formed with the second center panel 18. The third center panel 20 also includes a fourth drop section 180 near the rear portion 154 of second inner surface 142. The fourth drop section 180 extends between the fifteenth and sixteenth inclined ramps 148,150, and will be fully formed with the right end panel 14.

A fourth storage portion 200 is located on the second surface 142 near the front portion 152 of the third center panel 20. The fourth storage portion 200 includes a seventh bottom shelf 201 and seventh rear wall 203. The top of the fourth storage portion 200 is formed by a part of the fifteenth inclined ramp 148. The fourth storage portion 200 will be fully formed with the right end panel 14 similar to the first storage portion 40 described above.

The third center panel 20 also includes a fourth dispensing area 177 at a bottom of the front portion 152 at the second surface 142. The fourth dispensing area includes a generally oval shaped fourth cutout 178 in the third center panel 20, similar to the first cutout 52 in the left end panel 12. It also includes a portion of the fourth bottom flange 174. The fourth dispensing area 177 will be fully formed with the right end center panel 14 as described above with respect to the left end panel 12 and first center panel 16.

The right end panel 14 is a mirror image of the left end panel 12. The right end panel 14 includes an outer surface 182 and an inner surface 184. On the inner surface 184, the right end panel 14 has a third inclined ramp 186 and a fourth inclined ramp 188. The third and fourth inclined ramps 186,188 are inclined generally in a downward direction. The right end panel 14 also includes a front portion 190 and a rear portion 192. The third inclined ramp 186 is inclined toward the rear portion 192. The fourth inclined ramp 188 is inclined toward the front portion 190. Thus, the fourth inclined ramp 188 is inclined in a direction opposite to the third inclined ramp 186. The third inclined ramp 186 is inclined from the horizontal at the same angle as the first inclined ramp 26. The fourth inclined ramp 188 is inclined from the horizontal at the same angle as the second inclined ramp 28.

The third inclined ramp 186 extends inward from the inner surface 184 of the right end panel 14. Also extending from the inner surface 184 is a fifth top flange 194. The fifth top flange 194 is inclined at the same angle as the third inclined ramp 186 and forms a portion of a seventh passageway 161 with the third center panel 20.

The fourth inclined ramp 188 extends inward from the inner surface 184 of the right end panel 14. Also extending from the inner surface 184 is an eighth guide flange 196. The eighth guide flange 196 is located below the third inclined ramp 186 and above the fourth inclined ramp 188 and forms a part of an eighth passageway 198 with the third center panel 20 Eighth guide flange 196 is inclined at the same angle to the horizontal as the fourth inclined ramp 188.

A fourth storage portion 200 is located on the inner surface 184 near the front portion 190 of the right end panel 14. The fourth storage portion 200 includes an eighth bottom shelf 202 and an eighth rear wall 204. The top of the fourth storage portion 202 is formed by a part of the third inclined ramp 186. The fourth storage portion 202 will be fully formed with the third center panel 20.

Extending inward from the inner surface 184 vertically along a rear edge of rear portion 192 of the right end panel 14 is a first back flange 206. Extending inward from an inner surface 184 horizontally along a bottom edge of the right end panel 14 is a fifth bottom flange 208.

The right end panel 14 also includes a fourth dispensing area 177 at a bottom of the front portion 190. The fourth dispensing area 177 includes a generally oval shaped fifth cutout 210 in the right end panel 14. It also includes a portion of the fifth bottom flange 208.

The right end panel 14 further includes a fourth drop section 180 near the rear portion 192. The fourth drop section 180 extends between the third and fourth inclined ramps 186 and 188, and will be fully formed with the third center panel 20.

In an embodiment only the left and right end panels 12 and 14 need be connected. If additional display space, center panels such as those of the first, second, and third center panels, 16,18,20 can be used. When additional panels are used they are connected tabs similar to those of 86,87.

A front face panel 300 can be attached at the front portions 30,56 of the left end panel 12 and first center panel 16. The front face panel 300 is attached above the first dispensing area 50, and may include indicia 302 such as the name of the product stored in the dispenser 10. The front face panel 300 includes hinges 304 that cooperate with hinge receptors to allow the front face panel 300 to rotate upward and downward to close and open the front face panel 300 to allow the dispenser 10 to be loaded with cans 11, and to hide the cans 11. Additional front face panels 300 can similarly be attached to front portions of the second and third center panels 18 and 20, as well as right end panel 14.

In an embodiment, an aisle flag 400 can be used. The flag 400 can be any desired shape, and can be attached to left or right end panels 12 or 14, and can include indicia to alert customers to the products contained in the dispenser 10.

Stops 500 can also be used to prevent cans 11 from going past a certain point in the dispensing areas. The stops 500 are preferably made of plastic and attach to the left or right end panels or center panels in the lower passageways.

In another embodiment shown in FIGS. 16-31, the dispenser 10 includes left and right end panels 600, 602. These end panels 600, 602 are substantially like left and right end panels 12, 14 described above. The dispenser 10 of this embodiment also includes first and second center panels 604, 606, also substantially like first and second center panels 16 and 18 described above. In this embodiment, the first and second center panels 604, 606 and left and right end panels 600, 602 each include an eyelet 612 on the exterior of back flanges 608, 610. The back flanges 608, 610 also include a first back opening 614 and a second back opening 616. The first back opening 614 also extends into top flanges 618, 619 of the left and right end panels 600, 602 and first and second center panels 604, 606.

As shown in FIGS. 23-26, a rocker arm 620 is attached via eyelets 612 to each of the pairs of adjacent center panels 604, 606 and center and end panels 600, 602. The rocker arm 620 includes an arm member 622. The arm member 622 is generally parabolic-shaped. At a first end of the arm member 622 is an arm extension 624. Attached to the arm extension 624 is a can abutment surface 626. The can abutment surface 626 extends into the first inclined passageway 36. At the other end of the arm member 622 is a foot 628 extending in the same direction as the arm extension 624. The foot 628 extends into a landing section 630 of the second inclined passageway 39. The arm member 622 also includes a first side surface 632 and a second side surface 634. It further includes a pair of projections 636, each extending outwardly from the first and second side surfaces 632, 634, and generally near the center of the arm member 622. The projections 636 of the rocker arm 620 are inserted into the eyelets 612 to mount the rocker arm 620 to the dispenser 10. The first back opening 614 permits the top portion of the rocker arm 620 to extend therethrough, including the abutment surface 626. The second back opening 616 permits the foot 628 of the rocker arm 620 to extend therethrough.

The rocker arm 620 operates as follows, shown more particularly in FIGS. 23-26. As a can 11 is removed from the dispenser 10, cans 11 in the first passageway 36 slide towards the rear of the dispenser 10. The rearmost can 638 impacts the abutment surface 626. The rearmost can 638 pushes on the surface 626 towards the rear of the dispenser 10 under the force of gravity, thereby causing the foot 628 to move into the landing section 630 and toward the front of the dispenser 10 and impel a can 11 in the landing section 630 to move from the landing section 630 into the lower inclined passageway 39 to move toward the front of the dispenser 10. This makes room for the rearmost can 638 to drop from the upper inclined passageway 36 through the first drop section 54 to the landing section 630 and to the lower inclined passageway 39.

In a further embodiment shown in FIGS. 16-31, and particularly in FIGS. 27-31, the dispenser 10 includes a sliding floor 640. The first bottom shelf 42 in the first storage portion 40 of each of the center and end panels includes a gap 642 over with the sliding floor 640 sits. The gap 642 is sufficiently large that it can accommodate a can 11 to fall therethrough. The sliding floor 640 is generally planar and rectangular-shaped. It has an upper side 644 and an underside 646. Guides 648 are located along the center line of the underside 646. The guides 648 fit between the bottom shelves 42, 76 of the panels 600, 604 to allow for fore and aft sliding of the sliding floor 640. The sliding floor 640 includes a handle portion 650 at one end for pulling the sliding floor 640 toward the front of the dispenser 10.

When a need for a can 11 from the first storage portion 40 occurs, such as when the dispenser is near empty, the sliding floor 640 is pulled toward the user and the front of the dispenser 10. The can 11 that was situated over the gap 642 in the bottom shelves 42, 76 falls down into the second passageway 39. The remaining cans 11 in the storage portion 40 slide back such that the rearmost can 11 in the storage portion 40 is situated over the gap 642. The sliding floor 640 can be repeatedly pulled forward until all cans 11 in the storage portion 40 are in the second passageway 39.

The rocker arm 620 and sliding floor 640 are described above with respect to a single pair of adjacent panels, in this instance the left end panel 600 and first center panel 604, but it should be understood that the description applies to the rocker arm 620 and sliding floor 640 located between any adjacent panels.

While the specific embodiments have been illustrated and described, numerous modifications come to mind without significantly departing from the spirit of the invention, and the scope of protection is only limited by the scope of the accompanying claims.

What is claimed is:

1. A can dispenser for dispensing cans in an upright position wherein each can has a first end, a second end and a sidewall extending between the first end and the second end a first distance, the dispenser comprising:

a left end panel, the left end panel including a first inclined ramp and a second inclined ramp, both on an inner surface thereof, the second inclined ramp inclined in a direction opposite to the first inclined ramp; and a right end panel connectable to the left end panel, the right end panel including a third inclined ramp cooperating with the first inclined ramp to form a first inclined passageway having a width that is configured to be less than the first distance, and a fourth inclined ramp on an inner surface of the right end panel, the fourth inclined ramp cooperating with the second inclined ramp to form a second inclined passageway, the first inclined passageway inclined in a direction opposite to the second inclined passageway;

wherein the left end panel and the right end panel each further include fixed inner walls that are interconnected to form a first generally rectangular storage section between the left end panel and the right end panel, wherein the first storage section is configured to receive additional cans for storage between the first inclined passageway and the second inclined passageway, wherein, when in use, the inner walls prevent the additional cans in the first storage section from moving to the first and second inclined passageways; and wherein the inner walls of the left end panel and the right end panel each include a bottom wall forming a top wall for a portion of the second inclined passageway; and wherein the left end panel and the right end panel each further include a first guide flange forming a top wall for a second portion of the second inclined passageway;

wherein each first guide flange is horizontally spaced apart from each bottom wall of the first storage section respectively defining a gap therebetween.

2. The dispenser of claim 1 wherein the first and second inclined passageways are each inclined at an angle to allow the cans to slide therein by the force of gravity.

3. The dispenser of claim 1 wherein the second inclined passageway includes a landing section.

4. The dispenser of claim 1 wherein the first inclined passageway is inclined at an angle in a range of approximately six to twenty-five degrees.

5. The dispenser of claim 1 wherein the second inclined passageway is inclined at an angle in a range of approximately six to twenty-five degrees.

6. The dispenser of claim 1 wherein each first guide flange is parallel to the second and the sixth inclined ramps.

7. A can dispenser for dispensing cans in an upright position wherein each can has a first end, a second end and a sidewall extending between the first end and the second end a first distance, the dispenser comprising:

a left end panel, the left end panel including a first inclined ramp and a second inclined ramp, both on an inner surface thereof, the second inclined ramp inclined in a direction opposite to the first inclined ramp;

a right end panel, the right end panel including a third inclined ramp and a fourth inclined ramp on an inner surface thereof, the third inclined ramp inclined in the same direction as the first inclined ramp, and the fourth inclined ramp inclined in the same direction as the second inclined ramp; and a first center panel, the first center panel including a fifth inclined ramp and a sixth inclined ramp, both on a first surface thereof, and a seventh inclined ramp and an eighth inclined ramp, both on a second surface thereof, the fifth and sixth inclined ramps cooperating with the first and second inclined ramps of the left end panel to form first and second inclined passageways each having a width that is configured to be less than the first distance, and the seventh and eighth inclined ramps cooperating with the third and fourth inclined ramps of the right end panel to form third and fourth inclined passageways, the first and third inclined passageways inclined in a direction opposite to the second and fourth inclined passageways; wherein the left end panel and the first center panel each further include a first set of fixed inner walls that are interconnected to form a first generally rectangular storage section between the left end panel and the first center panel, wherein the first storage section is configured to receive a first set of additional cans for storage between the first inclined passageway and the second inclined passageway, wherein, when in use, the first set of inner walls prevent the first set of additional cans in the first storage section from moving to the first and second inclined passageways;

wherein the first set of inner walls of the left end panel and the first center panel each further include a bottom wall forming a first top wall for a first portion of the second inclined passageway;

wherein the right end panel and the first center panel further include a second set of fixed inner walls that are interconnected to form a second generally rectangular storage section between the right end panel and the first center panel, wherein the second storage section is configured to receive a second set of additional cans for storage between the third and fourth inclined passageways, wherein, when in use, the second set of inner walls prevent the second set of additional cans in the second storage section from moving to the third and fourth inclined passageways;

wherein the second set of inner walls of the right end panel and the first center panel each further include a bottom wall forming a first top wall for a first portion of the fourth inclined passageway;

wherein the left end panel and the first center panel each further include a first guide flange forming a second top wall for a second portion of the second inclined passageway, each first guide flange being horizontally spaced apart from each bottom wall of the first storage section respectively; and wherein the right end panel and the first center panel each further include a second guide flange forming a second top wall for a second portion of the fourth inclined passageway, each second guide flange being horizontally spaced apart from each bottom wall of the second storage section respectively defining a gap therebetween.

* * * * *